US011581180B2

(12) United States Patent
Canterbury et al.

(10) Patent No.: US 11,581,180 B2
(45) Date of Patent: Feb. 14, 2023

(54) APPARATUS AND METHODS FOR INJECTING IONS INTO AN ELECTROSTATIC TRAP

(71) Applicant: THERMO FINNIGAN LLC, San Jose, CA (US)

(72) Inventors: Jesse D. Canterbury, Shoreline, WA (US); Michael W. Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 23 days.

(21) Appl. No.: 17/355,958

(22) Filed: Jun. 23, 2021

(65) Prior Publication Data

US 2022/0415641 A1 Dec. 29, 2022

(51) Int. Cl.
*H01J 49/42* (2006.01)
*H01J 49/02* (2006.01)
(Continued)

(52) U.S. Cl.
CPC ..... *H01J 49/4265* (2013.01); *H01J 49/0031* (2013.01); *H01J 49/022* (2013.01);
(Continued)

(58) Field of Classification Search
CPC .. H01J 49/4265; H01J 49/0031; H01J 49/022; H01J 49/067; H01J 49/425; H01J 49/4295
(Continued)

(56) References Cited

U.S. PATENT DOCUMENTS

2012/0326023 A1* 12/2012 Kozole ..... H01J 49/067 250/288
2013/0264474 A1* 10/2013 Kholomeev ..... H01J 49/0031 250/336.1
(Continued)

FOREIGN PATENT DOCUMENTS

WO 2020/121168 A1 6/2020

OTHER PUBLICATIONS

Perry et al. "Rephrasing ion Packets In the Orbitrap Mass Analyzer to Improve Resolution and Peak Shape," Journal of the American Society for Mass Spectrometry, Elsevier Science Inc., vol. 20, No. 8, Aug. 1, 2009.
(Continued)

*Primary Examiner* — Nicole M Ippolito
(74) *Attorney, Agent, or Firm* — Thomas F. Cooney

(57) ABSTRACT

A mass spectrometry method comprises: storing a first packet of ions within an ion storage apparatus; transferring the first ion packet into an electrostatic trap mass analyzer through a set of electrostatic lenses, wherein, during the transfer, either the lenses are operated in a first mode of operation or an injection voltage of a first pre-determined magnitude is applied to an electrode of the mass analyzer; mass analyzing the first ion packet using the mass analyzer; storing a second packet of ions within the ion storage apparatus; transferring the second ion packet into the mass analyzer through the set of lenses, wherein, during the transfer, either the lenses are operated in a second mode of operation or an injection voltage of a second pre-determined magnitude is applied to the electrode of the mass analyzer; and mass analyzing the second packet of ions using the electrostatic trap mass analyzer.

19 Claims, 10 Drawing Sheets

(51) Int. Cl.
*H01J 49/00* (2006.01)
*H01J 49/06* (2006.01)

(52) U.S. Cl.
CPC ..... *H01J 49/067* (2013.01); *H01J 49/425* (2013.01); *H01J 49/4295* (2013.01)

(58) Field of Classification Search
USPC ..... 250/281, 282, 283
See application file for complete search history.

(56) References Cited

U.S. PATENT DOCUMENTS

| | | | | |
|---|---|---|---|---|
| 2017/0352530 | A1 | 12/2017 | Belov et al. | |
| 2018/0144921 | A1* | 5/2018 | Hoyes | H01J 49/0031 |
| 2021/0242007 | A1* | 8/2021 | Verenchikov | H01J 49/406 |

OTHER PUBLICATIONS

EP Extended Search Report and Written Opinion dated Nov. 16, 2022, for EP Patent Application No. 22180646.6.

* cited by examiner

APPARATUS AND METHODS FOR INJECTING IONS INTO AN ELECTROSTATIC TRAP

FIELD OF THE INVENTION

The present invention relates generally to mass spectrometry and mass spectrometers and, more particularly, relates to operation of electrostatic trap mass analyzers and to operation of mass spectrometer systems employing electrostatic trap mass analyzers.

BACKGROUND OF THE INVENTION

Electrostatic traps are a class of ion optical devices where moving ions experience multiple reflections or deflections in substantially electrostatic fields. Unlike trapping in RF field ion traps, trapping in electrostatic traps is possible only for moving ions. Thus, a high vacuum is required to ensure that this movement takes place with minimal loss of ion energy due to collisions over a data acquisition time $T_m$. Since its commercial introduction in 2005, the ORBITRAP™ mass analyzer, which belongs to the class of electrostatic trap mass analyzers, has become widely recognized as a useful tool for mass spectrometric analysis. In brief, the ORBITRAP™ mass analyzer, which is commercially available from Thermo Fisher Scientific of Waltham Mass. USA, is a type of electrostatic trap mass analyzer that is substantially modified from the earlier Kingdon ion trap. FIGS. 1A and 1B, discussed further below, provide schematic illustrations of portions of an ORBITRAP™ mass spectrometer system and an ORBITRAP™ mass analyzer, respectively. Electrostatic trapping mass spectrometer systems and mass analyzers of the type illustrated in FIGS. 1A-1B provide accurate mass-to-charge (m/z) measurements and high m/z resolution similar to what is achievable with Fourier Transform Ion Cyclotron Resonance (FT-ICR) mass spectrometry instrumentation without the requirement for high-strength magnets. Structural and operational details of ORBITRAP™ mass analyzers and mass spectrometers employing such mass analyzers are described in Makarov, Electrostatic Axially Harmonic Orbital Trapping: A High-Performance Technique of Mass Analysis, Anal. Chem., 72(6), 2000, pp. 1156-1162 and in U.S. Pat. No. 5,886,346 in the name of inventor Makarov and in U.S. Pat. No. 6,872,938 in the names of inventors Makarov et al.

In both FT-ICR and ORBITRAP™ mass analyzers, ions are compelled to undergo collective oscillatory motion within the analyzer that induces a correspondingly oscillatory image charge in neighboring detection electrodes, thereby enabling detection of the ions. The oscillatory motion used for detection may be of various forms including, for example, circular oscillatory motion in the case of FT-ICR and axial oscillatory motion while orbiting about a central electrode in the case of a mass spectrometer system or mass analyzer of the type schematically illustrated in FIGS. 1A-1B. The oscillatory image charge in turn induces an oscillatory image current and corresponding voltage in circuitry connected to the detection electrodes. This signal is then typically amplified, digitized and stored in computer memory. The signal-versus-time record is referred to as a transient (i.e. a transitory signal in the time domain).

The oscillating ions induce oscillatory image charge and oscillatory current at frequencies which are related to the mass-to-charge (m/z) values of the ions. Each ion of a given mass to charge (m/z) value will oscillate at a corresponding given frequency such that it contributes a signal to the collective ion image current which is generally in the form of a periodic wave at the given frequency. The total detected image current of the transient is then the resultant sum of the image currents at all the frequencies present (i.e. a sum of periodic signals). Frequency spectrum analysis (such as Fourier transformation) of the transient yields the oscillation frequencies associated with the particular detected oscillating ions; from the frequencies, the m/z values of the ions can be determined (i.e. the mass spectrum) by known equations with parameters determined by prior calibration experiments.

More specifically, an ORBITRAP™ mass analyzer includes an outer barrel-like electrode and a central spindle-like electrode along the axis. Referring to FIG. 1A, a portion of a mass spectrometer system including an ORBITRAP™ mass analyzer is schematically shown in longitudinal section view. The mass spectrometer system 1 includes an ion storage apparatus 2 and an electrostatic orbital trapping mass analyzer 4. The ion storage apparatus 2, in this case, is a curved multipolar curvi-linear trap (known as a "C-trap"). Ions are ejected radially from the "C-trap" in a pulse to the Orbitrap. For details of the curved trap, or C-trap, apparatus and its coupling to an electrostatic trap, please see U.S. Pat. Nos. 6,872,938; 7,498,571; 7,714,283; 7,728,288; and 8,017,909 each of which is hereby incorporated herein by reference in its entirety. The C-trap may receive and trap ions from an ion source 3 which may be any known type of source such as an electrospray (ESI) ion source, a Matrix-Assisted Laser Desorption Ionization (MALDI) ion source, a Chemical Ionization (CI) ion source, an Electron Ionization (EI) ion source, etc. Additional not-illustrated ion processing components such as ion guiding components, mass filtering components, linear ion trapping components, ion fragmentation components, etc. may optionally be included (and frequently are included) between the ion source 3 and the C-trap 2 or between the C-trap and other parts of the mass spectrometer. Other parts of the mass spectrometer which are not shown are conventional, such as additional ion optics, vacuum pumping system, power supplies etc.

Other types of ion storage apparatuses may be employed in place of the C-trap. For example, the aforementioned U.S. Pat. No. 6,872,938 teaches the use of an injection assembly comprising a segmented quadrupole linear ion trap having an entrance segment, an exit segment, an entrance lens adjacent to the entrance segment and an exit lens adjacent to the exit segment. By appropriate application of "direct-current" (DC) voltages on the two lenses as well as on the rods of each segment, a temporary axial potential well may be created in the axial direction within the exit segment. The pressure inside the trap is chosen in such a way that ions lose sufficient kinetic energy during their first pass through the trap such that they accumulate near the bottom of the axial potential well. Subsequent application of an appropriate voltage pulse to the exit lens combined with ramping of the voltage on a central spindle electrode causes the ions to be emptied from the trap axially through the exit lens electrode and to pass into the electrostatic orbital trapping mass analyzer 4.

The electrostatic orbital trapping mass analyzer 4 comprises a central spindle shaped electrode 6 and a surrounding outer electrode which is separated into two halves 8*a* and 8*b*. FIG. 1B is an enlarged cross-sectional view of the inner and outer electrodes. The annular space 17 between the inner spindle electrode 6 and the outer electrode halves 8*a* and 8*b* is the volume in which the ions orbit and oscillate and comprises a measurement chamber in that the motion of ions within this volume induces the measured signal that is used to determine the ions m/z ratios and relative abundances. The internal and outer electrodes (central electrode 6 and outer electrodes 8*a*, 8*b*) are specifically shaped such that, when supplied with appropriate voltages will produce respective electric fields which interact so as to generate, within the measurement chamber 17, a so-called "quadro-logarithmic potential", U, (also sometimes referred to as a "hyper-logarithmic potential") which is described in cylindrical coordinates (r, z) by the following equation:

$$U = \frac{a}{2}\left(z^2 - \frac{r^2}{2}\right) + b\ln\left(\frac{r}{c}\right) + d \qquad \text{Eq. 1}$$

where a, b, c, and d are constants determined by the dimensions of and the voltage applied to the orbital trapping analyzer electrodes, and where z=0 is taken at the axial position corresponding to the equatorial plane of symmetry 7 of the electrode structure. The "bottom" or zero axial gradient point of the portion of "quadro-logarithmic potential" dependent on the axial displacement (i.e. the portion which determines motion in the axial dimension, z, along the longitudinal axis 9) occurs at the equatorial plane 7. This potential field has a harmonic potential well along the axial (Z) direction which allows an ion to be trapped axially within the potential well if it does not have enough kinetic energy to escape. It should be noted that Eq. 1 represents an ideal functional form of the electrical potential and that the actual potential in any particular physical apparatus will include higher-order terms in both z and r.

The motions of trapped ions are associated with three characteristic oscillation frequencies: a frequency of rotation around the central electrode 6, an orbital frequency about a nominal rotational radius and a frequency of axial oscillations along the z axis. In order to detect the frequencies of oscillations, the motion of ions of a given m/z need to be coherent. The radial and rotational oscillations are only partially coherent for ions of the same m/z as differences in average orbital radius and size of radial oscillations correspond to different orbital and radial frequencies. It is easiest to induce coherence in the axial oscillations as ions move in an axial harmonic potential so axial oscillation frequency is independent of oscillation amplitude and depends only on m/z. Therefore, the axial oscillation frequencies are the only ones used for mass-to-charge ratio determinations. The outer electrode is formed in two parts 8*a*, 8*b* as described above and is shown in FIG. 1B. The ions oscillate sinusoidally with a frequency, co, (harmonic motion) in the potential well of the field in the axial direction according to the following Eq. 2:

$$\omega = \sqrt{\frac{k}{(m/z)}} \qquad \text{Eq. 2}$$

where k is a constant. One or both parts 8*a*, 8*b* of the outer electrode are used to detect image current as the ions oscillate back and forth axially. The Fourier transform of the induced ion image current signal from the time domain to the frequency domain can thus produce a mass spectrum in a conventional manner. This mode of detection makes possible high mass resolving powers.

Ions having various m/z values which are trapped within the C-trap are preferentially injected from the C-trap into the electrostatic orbital trapping mass analyzer 4 in a temporally and spatially short packet through an ion inlet aperture 5 that is located at an axial position that is offset from the equatorial plane 7 of the analyzer. This off-center ion injection geometry enables so-called "excitation by injection" whereby the ions of the ion packet immediately commence orbital motions about the central electrode 6 as well as other oscillations within the mass analyzer in the quadro-logarithmic potential. The ions of the packet are injected into the ion inlet aperture 5 along an initial injection trajectory that is essentially tangential to the stable orbital trajectories within the mass analyzer. The ions oscillate axially between the two outer electrodes 8*a* and 8*b* while also orbiting around the inner electrode 6. The axial oscillation frequency of an ion is dependent on the m/z values of the ions contained within the ion packet so that ions in the packet with different m/z begin to oscillate at different frequencies.

The two outer electrodes 8*a* and 8*b* serve as detection electrodes. The oscillation of the ions in the mass analyzer causes an image charge to be induced in the electrodes 8*a* and 8*b* and the resulting image current in the connected circuitry is sensed as a signal that is amplified by an amplifier 10 (FIG. 1A) connected to the two outer electrodes 8*a* and 8*b*. The amplified signal is digitized by a digitizer 12. The resulting digitized signal (i.e. the transient) is then received by an information processor 14 and stored in computer-readable memory. The memory may be part of the information processor 14 or, alternatively, comprise a separate component. For example, the information processor 14 may comprise a computer running a program having elements of program code designed for processing the transient. The computer 14 may be connected to an output means 16, which can comprise one or more of: computer memory, an output visual display unit, a printer, a data writer or the like.

The information processor 14 performs a Fourier transformation (or other mathematical transformation) on the data of the received transient. For example, the mathematical method of discrete Fourier transformation may be employed to convert the transient in the time domain, which comprises the mixture of periodic transient signals which result from the mixture of m/z present among the measured ions, into a spectrum in the frequency domain. If desired, at this stage or later, the frequency domain spectrum can be converted into the m/z domain by straightforward calculation. The discrete Fourier transformation produces a spectrum which has a profile point for each frequency or m/z value, and these profile points form a peak at those frequency or m/z positions where an ion signal is detected (i.e. where an ion of corresponding m/z is present in the analyzer).

The mass spectrometer system 1 also includes one or more power supplies 18 that provide(s) appropriate oscillatory radio frequency (RF) and non-oscillatory (DC) voltages to electrodes of the ion source 3, the ion storage apparatus 2, the electrostatic orbital trapping mass analyzer 4 and other not-illustrated mass spectrometer components through various electrical lines or cables such as the lines or cables 27*a*, 27*b* and 27*c*, such voltages being necessary for the proper operation of the mass spectrometer. The electrodes to which voltages are provided include various electrostatic lenses and ion guides, some of which are illustrated in this document. The information processor 14, which may comprise one or more computers and/or logic controllers, provides control signals to the one or more power supplies 18 which control the timing and magnitude of voltages provided over the electrical lines or cables 27*a*-27*c* by the one or more power supplies 18. The timing of the controlled application of the various voltages may be controlled algorithmically by computer-readable instructions that are embedded within or are otherwise accessible by the information processor 14. Such instructions may be generally adaptable to the analytical requirements of various users and/or various samples. As is generally understood, the mass spectrometer system 1 also includes various not-illustrated vacuum pumps and associated evacuation lines and may comprise various other not-illustrated mass filtering, ion trapping and/or ion reaction components.

Ion injection into an ORBITRAP™ electrostatic trap mass analyzer and other electrostatic trap mass analyzers is a complex process compared to other mass spectrometry ion manipulations. The complexity arises as a result of the requirement to set the initial conditions of injected ions relatively far away from where they are detected. Ions that are to be injected are allowed to come to their thermal velocities in about 1 mtorr pressure of nitrogen within the C-trap or other ion storage apparatus 2. Subsequently, in practice, the electrical potential of the C-trap is raised from ground potential to an appropriate voltage (e.g., about 2400 V if the central spindle electrode 6 is at a voltage of about −5 kV) that causes the ejection of ions towards the ORBITRAP™ ion entrance slot 5. En route to the electrostatic trap mass analyzer, the ions pass through several electrostatic lenses, some of which are necessary for differential pumping concerns, while others attempt to shape the beam itself.

FIG. 1C schematically depicts a common lens configuration between a C-trap and an ORBITRAP™ electrostatic trap mass analyzer. The purpose of lens 33, which comprises individual electrodes 33*a*, 33*b*, 33*c* and 33*d*, is to offset the ion trajectory 31 by an offset distance, $\Delta y_{inj}$, generally 2 mm in practice, which helps to counter the effect of neutral gas molecules streaming from the C-trap to the ORBITRAP™. Generally, electrodes 33*a* and 33*d* are maintained at ground potential during ion injection while electrodes 33*b* and 33*c* are maintained at a same voltage, $V_0$, the polarity of which depends on the polarity of the ions being injected. For example, assuming that the injected ions are positively charged, the voltage, $V_0$ may be approximately −300 V. Provided that the field strength that is experienced by ions between the electrode pair 33*a*, 33*b* is identical to the field strength the that the ions experience between electrode pair 33*c* and 33*d*, then the ions enter and exit lens 33 at the same angle.

As shown in FIG. 1C, Einzel lens 36 (Szilagyi, M., *Electron and Ion Optics*, Plenum Press, 1988), which is disposed on the housing of the ORBITRAP™ mass analyzer and which comprises apertured electrode plates 37*a*, 37*b* and 37*c*, focuses the beam towards the ion injection aperture 5, which generally is provided in the form of a slot. Generally, electrode plate 37*b* may be maintained at approximately 1200 V (depending on specific configurations) while electrode plates 37*a* and 37*c* are maintained at ground potential. A second function of lens 36 is to counteract any beam expansion that might have occurred between the exit of lens 33 and the entrance of lens 36. Finally, a deflector electrode 34, which is mounted adjacent to the injection slot, forces the ions to follow a curved trajectory into the measurement chamber 17, and then "closes the door" by means of a change in potential so that the effect of the slot on ions' orbits within the measurement chamber 17 is as small as possible. For efficient capture, the injected ion packets are typically focused into the entrance slot 5; thus, all ions enter the trap with similar energies and trajectories.

The above-described ion injection mechanism works quite well, at least for "first-order" effects like capture of ions and observation of accurate mass assignments and ion abundances. However, for "second-order" effects, such as ion-ion interactions, and long-term ion cloud stability, the details of the injection process may become important. In particular, if the beam is spatially very small upon injection, then the possibility of ion-ion interactions is greater, and this condition improves long term ion cloud stability. Conversely, if the beam is more spread upon injection, ion-ion interactions are reduced, and highest mass resolutions are more difficult to achieve. The principal of ion-ion interaction affecting electrostatic trap mass spectrometry is ion cloud coupling, in which two clouds closely spaced in frequency of motion tend to acquire the same frequency, leading to observation of one mass spectral peak where there should be two. This phenomenon is known as peak coalescence.

In general, subtle change in mass analysis performance characteristics can result when injection conditions are varied slightly. In particular, if the beam is focused tightly, then the ion cloud may become compressed, leading to stronger ion-ion interactions. Strong interactions between different ion species having different mass-to-charge ratio (m/z) values produce negative consequences for ion cloud coupling and its mass spectral representation, peak coalescence. Conversely, if the beam is spread spatially upon entering the trap, ion-ion interactions are weaker, leading to improved resolution of closely spaced peaks, such as isotopic variant peaks.

Reduction of peak coalescence can be achieved through changing specific injection and transfer voltages, but these changes can potentially adversely affect other mass spectral characteristics, such as differential ion cloud loss of coherence, resulting in loss of isotope ratio fidelity.

SUMMARY OF THE INVENTION

This disclosure describes methods for exploiting ion optical lens aberrations in order to spread ion packets upon their entrance into an electrostatic trap, therefore leading to better space-charge tolerance without affecting other important performance characteristics. The novel methods in accordance with the present teachings exploit transfer-lens aberrations in order to control the degree of ion packet spreading at an injection slot of the electrostatic trap. According to one aspect of the present teachings, if the ion packet is directed slightly away from the central axis of a focusing lens, then ion optical geometrical aberrations will come into effect, and not all portions of an ion packet will have the same focal point at the slot. Stated differently, each ion packet will be spatially spread out at the injection slot. Directing the ion packets as described herein can be accomplished by changing the field strength of one or more transfer lenses upstream from the focusing lens, thereby inducing a lens asymmetry. In such an asymmetric configuration, ions may exit a transfer lens at a trajectory that is at an angle from that at which the ions entered the transfer lens. The ions traversing the resulting partially deflected trajectory will then enter the focusing lens along a line that is displaced from the central axis of the focusing lens. As a result, a focal region may be slightly shifted either upstream or downstream from an ion entrance aperture of the electrostatic trap and the ions of each packet will be spatially dispersed upon entrance into the trap.

In accordance with some embodiments of the present teachings, a method of operating a mass spectrometer system comprising an electrostatic trap mass analyzer, comprises:

storing a portion of a stream of ions generated from a sample by an ion source as a first packet of ions within an ion storage apparatus of the mass spectrometer system;

transferring the first stored packet of ions into an electrostatic trap mass analyzer through a set of electrostatic lenses, wherein, during the transfer of the first packet of ions into the electrostatic trap mass analyzer, either the electrostatic lenses are operated in a first mode of operation or an injection voltage of a first pre-determined magnitude is applied to an electrode of the mass analyzer;

mass analyzing the first packet of ions using the electrostatic trap mass analyzer;

storing a second portion of the stream of ions from the sample as a second packet of ions within the ion storage apparatus;

transferring the second stored packet of ions into the electrostatic trap mass analyzer through the set of electrostatic lenses, wherein, during the transfer of the second packet of ions into the electrostatic trap mass analyzer, either the electrostatic lenses are operated in a second mode of operation or an injection voltage of a second pre-determined magnitude is applied to the electrode of the mass analyzer; and mass analyzing the second packet of ions using the electrostatic trap mass analyzer.

In accordance with some other embodiments of the present teachings, a mass spectrometer system is provided, the system comprising:

an ion source;

an ion storage apparatus configured to receive ions from the ion source;

an electrostatic trap mass analyzer configured to receive packets of ions from the ion storage apparatus, the electrostatic trap mass analyzer comprising:

an inner spindle electrode; and one or more outer electrodes;

a space between inner spindle electrode and the one or more outer electrodes; and an ion inlet aperture of the one or more outer electrodes;

a set of ion lenses disposed between the ion storage apparatus and the electrostatic trap mass analyzer;

a power supply electrically coupled to the ion storage apparatus, the electrostatic trap mass analyzer and the set of ion lenses; and an information processor electrically coupled to one or more of the power supply, the ion storage apparatus, the electrostatic trap mass analyzer and the set of ion lenses and comprising computer readable instructions operable to:

cause storage of a portion of a stream of ions generated by the ion source as a first packet of ions within the ion storage apparatus;

cause transfer of the first stored packet of ions into the space of the electrostatic trap mass analyzer through the set of electrostatic lenses, wherein, during the transfer of the first packet of ions into the space, either the electrostatic lenses are operated in a first mode of operation or an injection voltage of a first pre-determined magnitude is applied to the spindle electrode;

cause the electrostatic trap mass analyzer to mass analyze the first packet of ions;

cause storage of a second portion of the stream of ions as a second packet of ions within the ion storage apparatus;

cause transfer of the second stored packet of ions into the electrostatic trap mass analyzer through the set of electrostatic lenses, wherein, during the transfer of the second packet of ions into the electrostatic trap mass analyzer, either the electrostatic lenses are operated in a second mode of operation or an injection voltage of a second pre-determined magnitude is applied to the electrode of the mass analyzer; and cause the electrostatic trap mass analyzer to mass analyze the second packet of ions.

The first and second ion packets may be derived from a single sample or from separate samples. The use of a first and a second mode of operation of the electrostatic lenses that are used to transfer the ions of the first and second packets, respectively, or the application of first and second injection voltages during the transfer of the first ion packet and the second ion packet, respectively, can enable different mass spectral characteristics to be separately optimized during the first and second mass analyses, respectively. For example, during one of the mass analyses, the mode of operation or the injection voltage may be chosen so that the introduced packet of ions is brought to a line focus or otherwise diffuse focal region upon entrance into the electrostatic trap, thereby reducing charge density within the trap during the analysis. Such reduced charge density can reduce undesirable peak coalescence within a mass spectrum that results from the mass analysis but may adversely affect other mass spectral characteristics, such as overall resolving power and isotope ratio fidelity.

If the two packets of ions are derived from a single sample, then the mode of lens operation or the applied injection voltage during the injection of the other packet may be chosen so as to optimize these other mass spectral characteristics. If the two packets of ions comprise different ion population sizes, either because they are derived from different samples or else from different portions or fractions of a same sample, then the change from a first to a second mode of lens operation or the change from a first to a second injection voltage may be made based on and in response to the different ion population sizes. For example, lens operating modes and/or injection voltages that disperse the focus and the ion cloud within the mas analyzer may be employed for large ion populations (i.e., ion packets having a large number of ions), whereas lens operating modes and/or injection voltages that maintain a tight focus and compact ion cloud within the mass analyzer may be employed for analyses of small ion populations.

The computer instructions of the information processor of the mass spectrometer system may be further operable to digitally analyze a mass spectrum generated by the mass analysis of the first packet of ions and to automatically, in response to the digital analysis of the mass spectrum, cause a change of the mode of operation of the electrostatic lenses from the first to the second mode of operation or a change of the injection voltage from the first to the second pre-determined magnitude. For example, if the digital analysis detects an undesirable level of peak coalescence within the mass spectrum, the computer instructions may automatically cause a change of either the mode of operation of the electrostatic lenses from the first to the second mode of operation or a change of the injection voltage from the first to the second pre-determined magnitude in response to the detected level of peak coalescence, whereby the change or changes are such as to reduce the level of peak coalescence in the subsequent mass analysis of the second packet of ions. On the other hand, if the digital analysis detects an acceptably low level of peak coalescence within the mass spectrum, the computer instructions may automatically cause a change of either the mode of operation of the electrostatic lenses from the first to the second mode of operation or a change of the injection voltage from the first to the second pre-determined magnitude, whereby the change or changes are such as to improve overall resolving power or to improve isotope ratio fidelity in the subsequent mass analysis of the second packet of ions.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

Figure 1A:
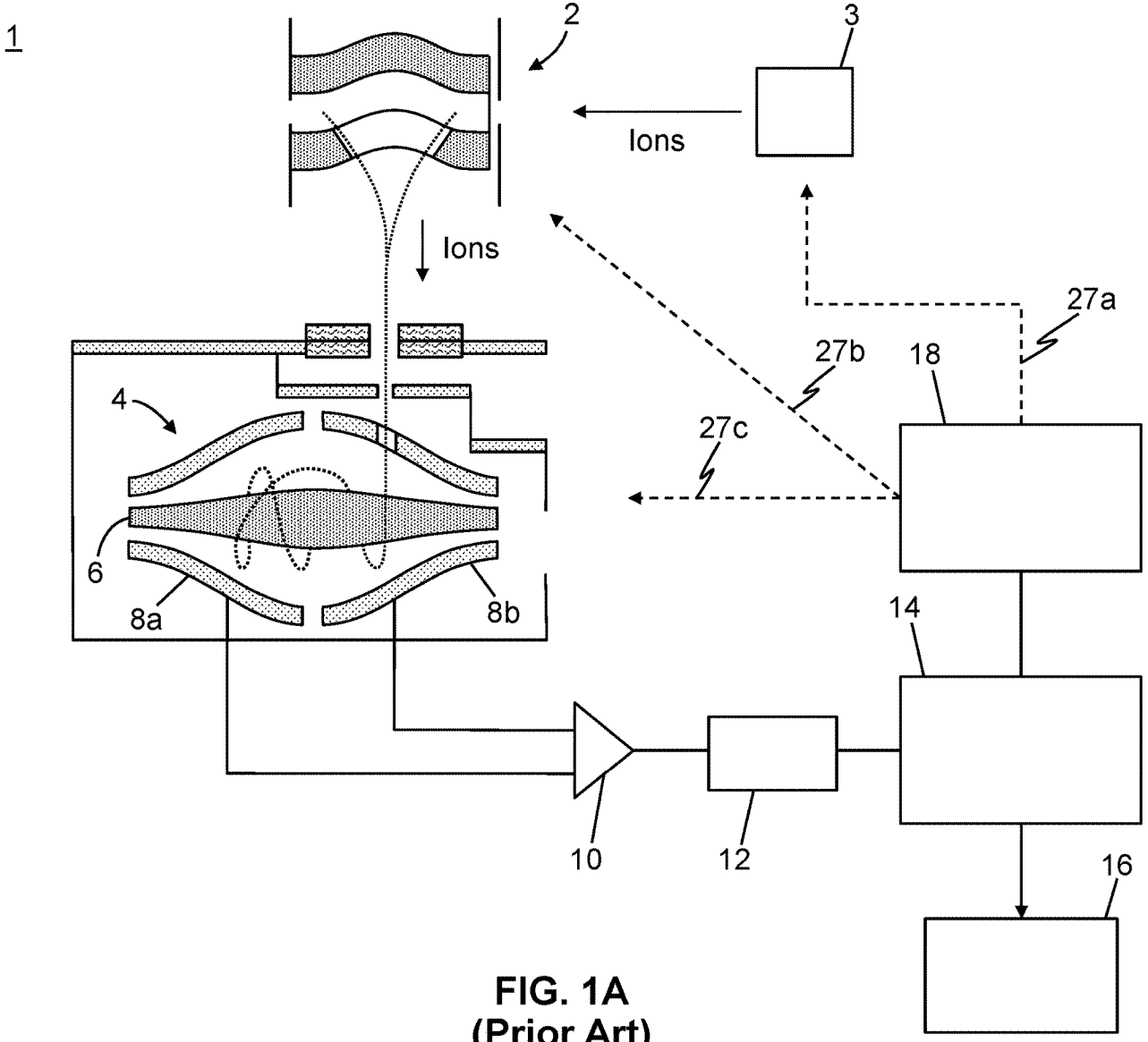
FIG. 1A (Prior Art)
FIG. 1A is a schematic depiction of a portion of a mass spectrometer system including an electrostatic trap mass analyzer, specifically an ORBITRAP™ electrostatic trap mass analyzer.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended figures taken in conjunction with the following description.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise. Moreover, it is to be appreciated that the figures, as shown herein, are not necessarily drawn to scale, wherein some of the elements may be drawn merely for clarity of the invention. In addition, reference numerals may be repeated among the various figures to show corresponding or analogous elements.

Unless otherwise defined, all other technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present description, such that slight and insubstantial deviations are within the scope of the present teachings. In this application, the use of the singular includes the plural unless specifically stated otherwise. In addition, the use of "comprise", "comprises", "comprising", "contain", "contains", "containing", "include", "includes", and "including" are not intended to be limiting. As used herein, "a" or "an" also may refer to "at least one" or "one or more." Also, the use of "or" is inclusive, such that the phrase "A or B" is true when "A" is true, "B" is true, or both "A" and "B" are true.

As used herein, the term "DC" (for "Direct Current") is used only for the purpose of designating a non-oscillatory voltage or non-oscillatory electrical potential applied to an electrode and does not necessarily imply the existence of a current that is carried by the movement of electrons through wires, electrodes or other conductors. The term "DC" is thus used herein to distinguish the referred-to voltage(s) from applied periodic oscillatory voltages, which themselves may be referred to as either "RF" (radio frequency) or "AC" voltages.

Figure 1B:
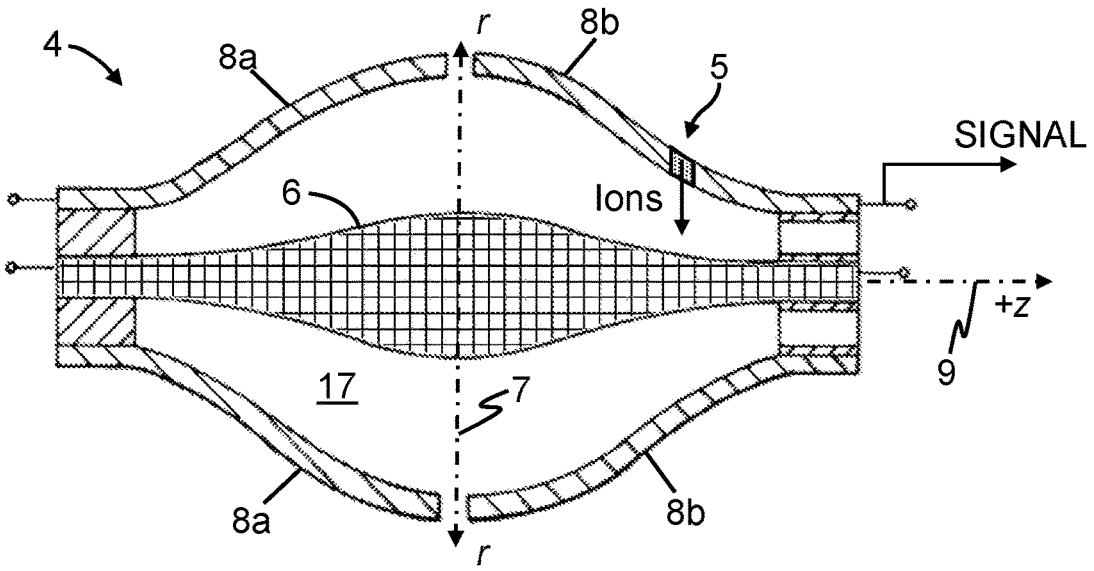
FIG. 1B (Prior Art)
FIG. 1B is an enlarged cross-sectional view of the electrostatic trap mass analyzer of FIG. 1A.
Figure 1C:
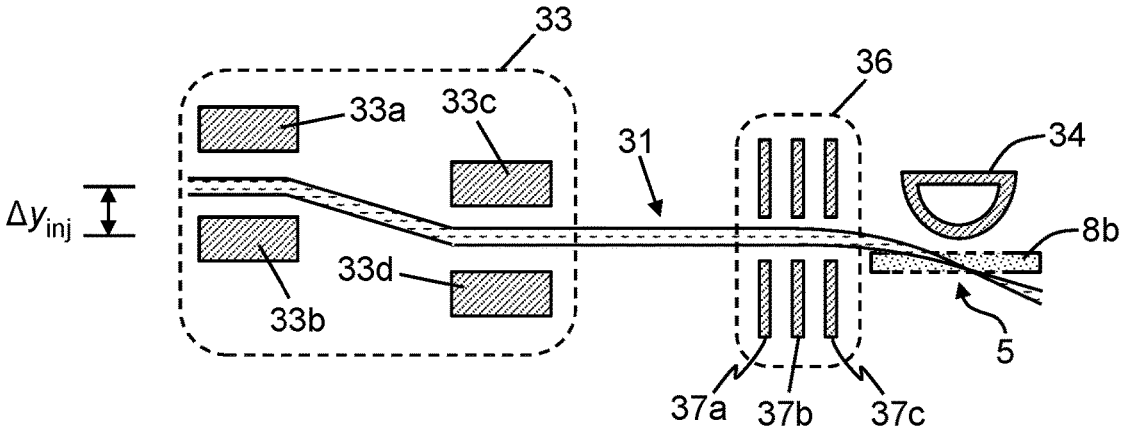
FIG. 1C (Prior Art)
FIG. 1C is a schematic depiction of a known configuration of ion lenses used to transfer and focus accumulated ions from an ion storage apparatus into an electrostatic trap mass analyzer.
Figure 2A:
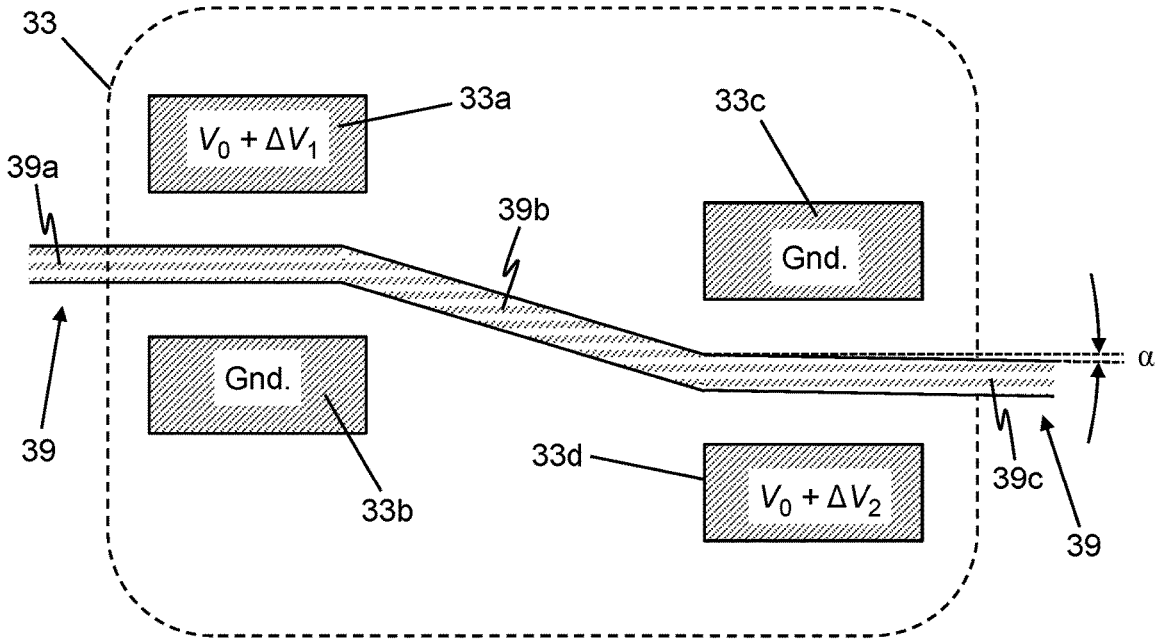
FIG. 2A is a schematic depiction of a method of using asymmetrically applied voltages to an ion transfer lens so as to cause the trajectory of ions exiting the lens to be at a slight angle to the trajectory of ions entering the lens.
Figure 2B:
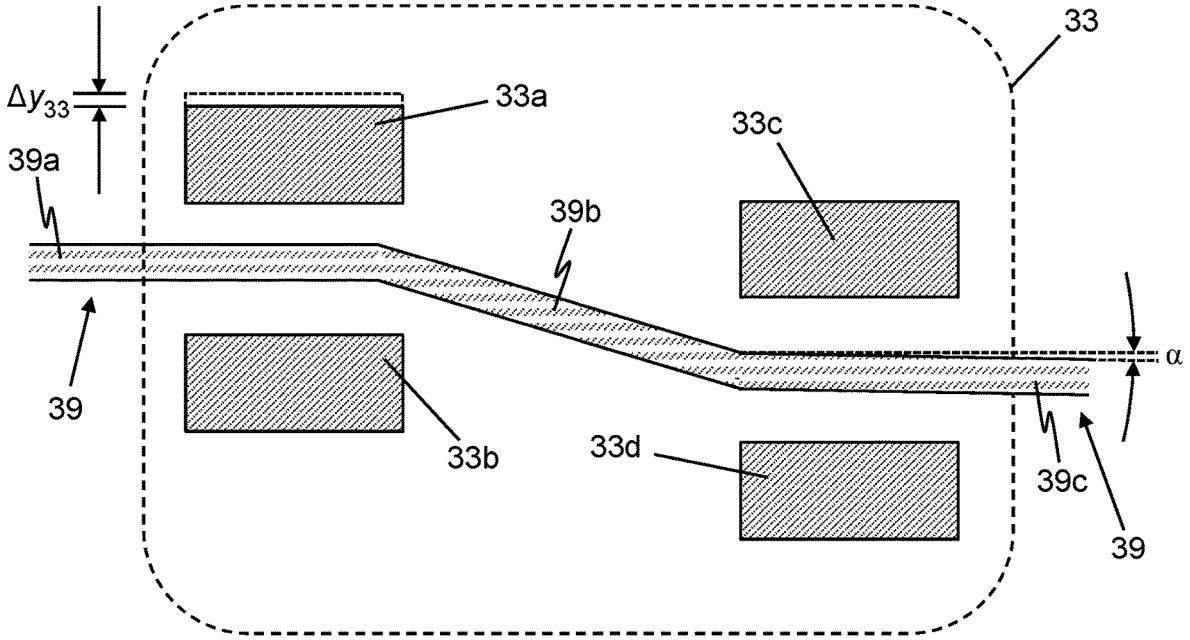
FIG. 2B is a schematic depiction of a method of offsetting the position of an electrode component of an ion transfer lens so as to cause the trajectory of ions exiting the lens to be at a slight angle to the trajectory of ions entering the lens.

FIGS. 2A-2B schematically depict two exemplary methods of causing slight perturbations in the operation of an ion transfer lens 33 as shown in FIG. 1C. As noted in the Background section of this document, the function of the ion transfer lens 33 is nominally to offset the position of the beam path while maintaining the direction of motion of ions exiting the lens parallel to the direction of motion of ions entering the lens. When both the ion transfer lens 33 and the focusing lens 36 are nominally operated in proper alignment with an ion storage apparatus 2, an ion injection aperture 5 of an electrostatic trap 4, and with one another, then the packet of ions is geometrically focused within the aperture 5 and the trajectories of the ions are substantially tangential to the stable ion orbital motions within the electrostatic trap. However, it has been observed that such nominal operation can sometimes result in coalescence of mass spectral peaks that correspond to ion species—such as isotopic variants of otherwise identical ions—that are closely spaced in m/z. The present inventors have recently recognized that the peak coalescence phenomenon can be significantly reduced by subtle changes to the nominal alignment of and/or nominal voltages applied to the lenses between the ion storage apparatus 2 and electrostatic trap 4.

In the following discussion, the electrodes 33*a* and 33*b* of the lens 33 are referred to as entrance electrodes of the lens because ions that arrive from the ion storage apparatus 2 first enter the lens between these two electrodes. Similarly, the electrodes 33*c* and 33*d* are referred to as exit electrodes because ions exit the lens 33 between this latter pair of electrodes. The electrodes 33*b* and 33*c* are herein referred to as being "diametrically-opposed to one another" or as a "pair of diametrically-opposed electrodes" because they are disposed both at opposite ends of the lens 33 relative to one another and are also disposed on opposite sides of an ion pathway (31, 32, 39) through the lens 33. For a similar reason, the electrodes 33*a* and 33*d* are also herein referred to as being "diametrically-opposed to one another" or as a "pair of diametrically-opposed electrodes."

The nominal operation of the transfer lens 33 is achieved when the ion path into the lens is precisely midway between the pair of entrance electrodes 33*a*, 33*b* and the pair of exit electrodes 33*c*, 33*d* and when the electric field between electrodes 33*c*, 33*d* is precisely reversed (i.e., same magnitude and opposite direction) relative to the electric field between the electrodes 33*a*, 33*b*. Accordingly, the direction of motion of the exiting ions may be caused to be non-parallel to the direction of motion of the incoming ions by either manipulation of the electric fields between the entrance and exit electrode pairs and/or by manipulation of the positions of the electrodes. Such latter operation in which the trajectories of ions entering and exiting the ion transfer lens 33 are not parallel to one another is herein referred to as a perturbed or non-nominal operation of the lens.

FIG. 2A schematically depicts how an asymmetric application of voltages to an ion transfer lens 33, in the absence of any manipulation of the positions of the electrodes relative to their nominal positions, may be employed to control the angle at which ions exit the lens. As noted above, the nominal operation of this lens comprises applying a voltage $V_0$ to electrodes 33*a* and 33*d* while maintaining electrodes 33*b* and 33*c* at ground potential. According to the operation depicted in FIG. 2A, one or more perturbation voltages are applied to respective individual electrodes. For example, as schematically shown in FIG. 2A, separate perturbation voltages, $\Delta V_1$ and $\Delta V_2$, may be added to the voltage $V_0$ that is applied to electrodes 33*a* and 33*d*, respectively. The perturbation voltages, $\Delta V_1$ and $\Delta V_2$, may be either positive or negative in sign and one of them may be equal to zero. However, $\Delta V_1$ and $\Delta V_2$ cannot be equal to one another, in both magnitude and sign. Because of the resulting asymmetry of the applied perturbation voltages, the magnitude of the ion path deflection from path segment 39*a* to path 39*b* is no longer precisely compensated by the ion path deflection from path segment 39*b* to 39*c*, as would otherwise be the case under nominal operation of the lens 33. As a result, upon exit of ions from the lens 33, the exit path segment 39*c* is not parallel to the initial path segment 39*a* of ions entering the lens. In this example, an angle, $\alpha$, exists between the trajectories of the entering and exiting ions. Although the perturbation voltages, $\Delta V_1$ and $\Delta V_2$, are illustrated, in FIG. 2A, as being applied to only the nominally energized electrodes 33*a* and 33*b*, the perturbation voltages may alternatively be applied to the nominally grounded electrodes 33*b*, 33*c* or, still further alternatively, perturbation voltages may be applied to three or all four of the electrodes of the lens 33.

FIG. 2B schematically depicts how manipulation of the position(s) of one or more of the electrodes an ion transfer lens 33 relative to their nominal positions may be employed to control the angle at which ions exit the lens while, at the same time, the voltages that are applied to the lens electrodes are identical to the voltages applied during nominal operation of the lens. For example, as depicted in FIG. 2B, the electrode 33*a* is illustrated as being offset, relative to its nominal position (shown in phantom), by an offset distance, $\Delta y_{33}$, thereby causing the pathway segment 39*a* of ions entering the lens 33 to initially pass more closely to lens 33*a* than to lens 33*b*.

Figure 3A:
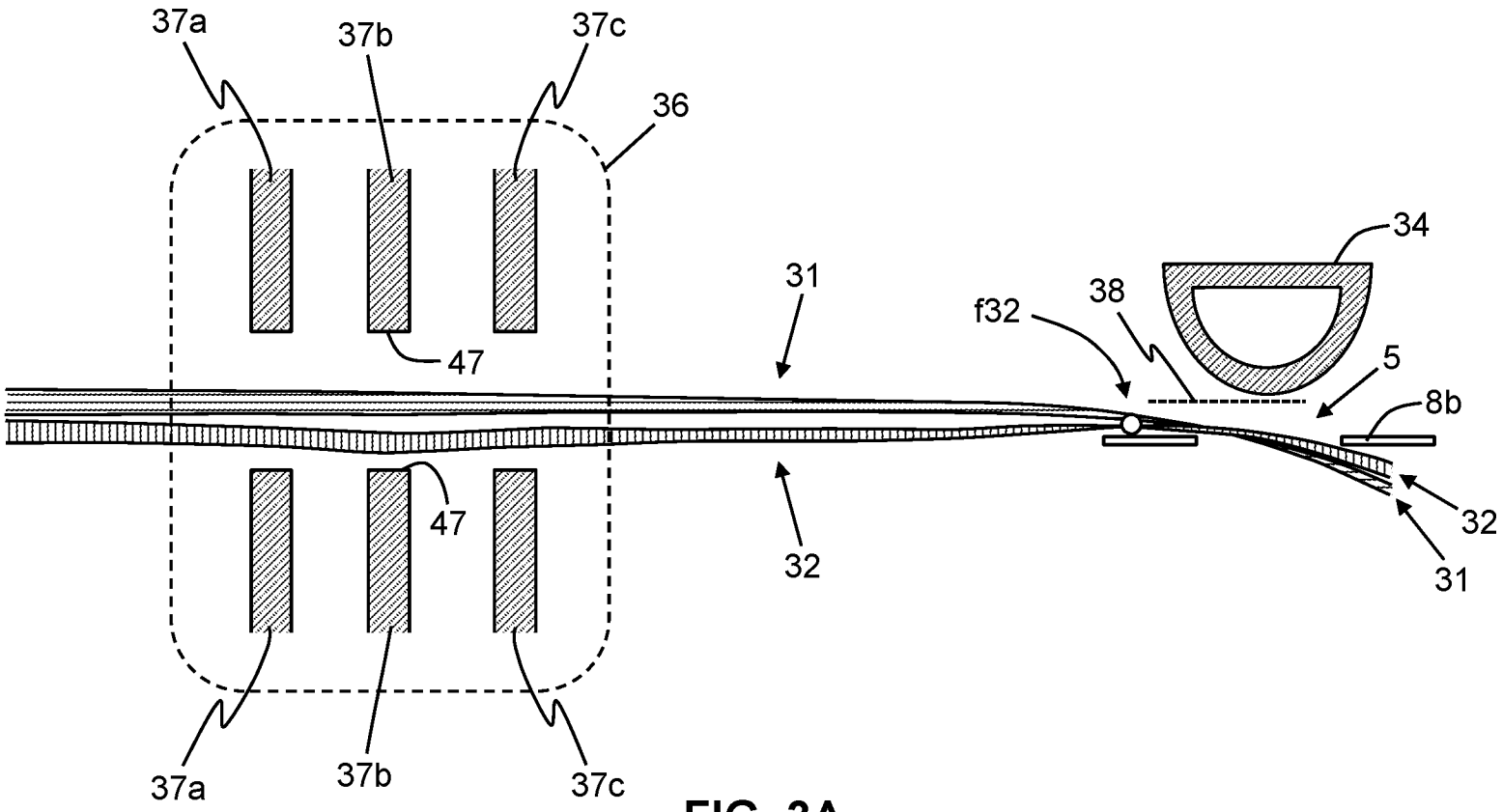
FIG. 3A is a schematic depiction of perturbed and unperturbed ion pathways through a focusing lens and into an ion injection slot of an electrostatic trap mass analyzer, the perturbed pathways caused by offsetting the position of an electrode component of an upstream ion transfer lens, as depicted in FIG. 2B.
Figure 3B:
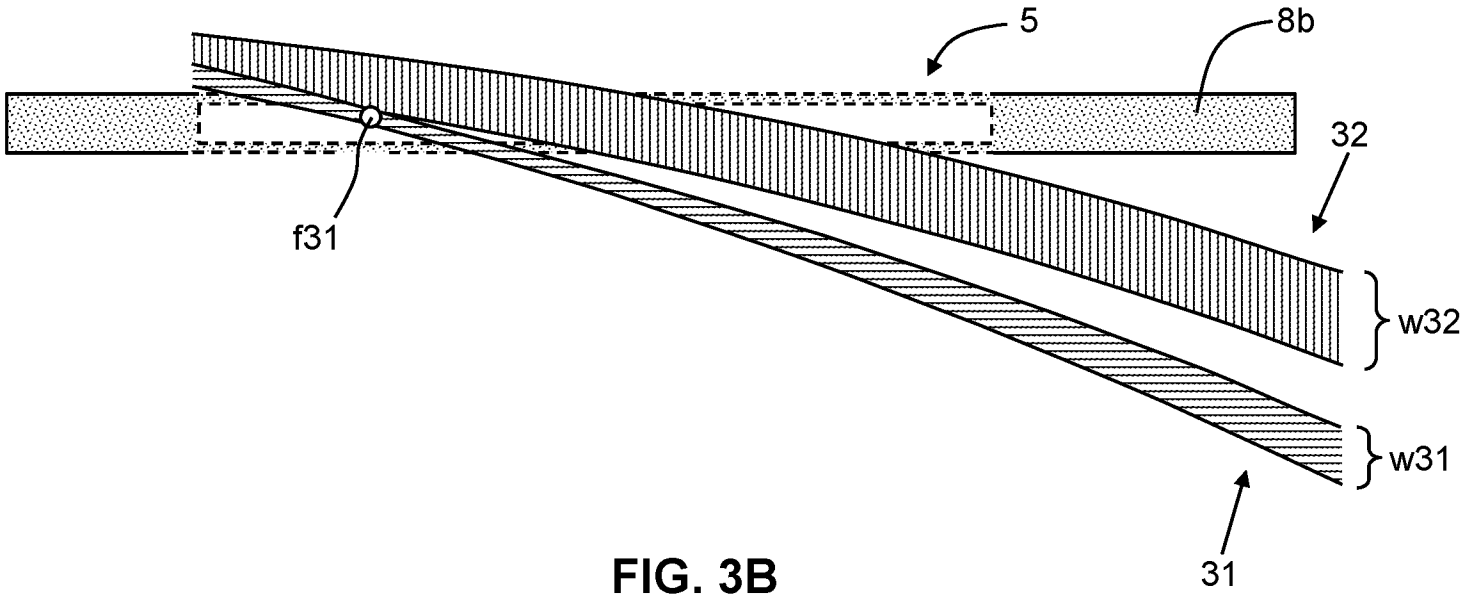
FIG. 3B is an enlargement of a portion of the perturbed and unperturbed ion pathways of FIG. 3A at the ion injection slot and also showing the nominal focal point of ions that follow the unperturbed pathway.

FIG. 3A is a schematic depiction of perturbed and unperturbed ion pathways through a focusing lens 36 and into an ion injection slot 5 of an electrostatic trap mass analyzer 4, as calculated by an ion-trajectory simulation computer program. The ion injection slot 5 is an aperture of one of the half-electrodes 8*a*, 8*b* that form the outer electrode portion of the electrostatic trap 4 (FIG. 1A). In FIGS. 3A-3B, the slot is depicted, for illustration purposes, as passing through the half-electrode 8*b*. FIG. 3B is an enlargement of a portion of the same calculated perturbed and unperturbed ion pathways in the vicinity of the injection slot. The unperturbed ion pathway 31 corresponds to nominal operation of the ion transfer lens 33 (not depicted in FIGS. 3A-3B). The perturbed pathway 32 corresponds to modified operation of the ion transfer lens in which the position of one member of the pair of electrodes of the ion transfer lens 33 was assumed to be offset, similarly to the offset $\Delta y_{33}$ that is depicted in FIG. 2B, in the direction of the other entrance electrode by 50 μm. Each simulation assumes that ions are introduced into the center of the ion transfer lens. In the simulations of both the nominal and perturbed modes of operation, the ions are forced into a curved trajectory under the influence of an electric field generated by deflector electrode 34 such that the ions pass into the measurement chamber 17 through the ion injection slot 5 in the outer half-electrode 8*b*.

As shown in FIG. 3A, the ion trajectory calculations show that, upon entry into the focusing lens 36, ions moving through the unperturbed lens system follow a pathway 31 that passes along a central axis of the focusing lens 36. Such ions experience balanced compressive forces within the lens 36 that cause each packet of ions to come to a focus at point f31 (FIG. 3B), which is the nominal focal point of the focusing lens 36. According to the nominal operation of the lens system, the lens 36 is positioned, relative to the injection slot 5 of the electrostatic trap mass analyzer, such that this focal point is within the slot.

The ion trajectory calculations that are schematically depicted in FIG. 3A also show that the pathway 32 of ions moving the perturbed lens system are displaced from the central axis of the focusing lens 36. Because of this displacement, ions that traverse the pathway 32 experience unbalanced repulsive forces from the electric field produced by the energized central plate electrode 37*b*. For example, as projected onto the plane of the drawing of FIG. 3A, ions having trajectories that pass close to the edge 47 of the central plate electrode 37*b* experience a greater force towards the central axis 38 of the lens 36 than the force that is experienced by ions having trajectories that bring them closer to the central axis. As a result, as projected onto the plane of the drawing of FIG. 3A, the ion packets appear to focus at a point f32 that is displaced upstream from the nominal focal point f31 within the ion injection slot 5. Although not specifically illustrated in FIGS. 3A-3B, the focusing of the ions that pass through the perturbed lens system is expected to be astigmatic; in other words, a projection of the ion trajectories onto a plane normal to the plane of the drawing of FIG. 3A is expected to yield an apparent focal point that is not coincident with point f32.

The inventors theorize that the greater calculated width w32 of ion packets that enter the electrostatic trap from the perturbed lens system, as compared to the calculated width w31 of ions packets that enter the trap from the nominal lens system arises from the combined aberrational effects of focus shifting and astigmatism that are introduced by the controlled perturbation. The greater initial spatial spread of ions that are introduced from the perturbed lens system is theorized to be able to reduce undesirable coupled ion-ion interactions between ion species having differing mass-to-charge ratios within the electrostatic trap, thereby reducing peak coalescence. This idea was tested in the laboratory using a nominally symmetric transfer lens 33. Data were taken using the lens in its nominal (symmetric, unperturbed) state, as well as with 50 μm shims inserted near the entrance aperture, similar to the depiction of FIG. 2B. The degree of peak coalescence was measured by measuring the A+2 peak of the tetrapeptide mass spectrometry calibration standard H-Met-Arg-Phe-Ala-OH (MRFA) at a mass spectral resolution of 240,000 at m/z of 200 Th, in order to resolve the peak into the $^{34}S$ peak and the $2\times^{13}C$ peak. From the observed mass spectra of the isotopic variants, the signal-to-noise ratio (S/N) of the $^{34}S$ peak was monitored as the concentration of the targeted ions were increased. The point at which the two peaks coalesce is then recorded and deemed the coalescence threshold. Table 1 below shows the difference in this measurement for the shimmed versus the un-shimmed cases. In both cases isotope ratios were mainly unaffected, while the coalescence threshold was doubled. From the results shown in the table, the introducing of the lens perturbation is seen to significantly reduce coalescence.

TABLE 1

| OPERATIONAL MODE | EXPERIMENTAL CONDITION | COALESCENCE THRESHOLD |
|---|---|---|
| Nominal | No shims | 1500 |
| Perturbed | 50 μm shims at entrance | 3100 |

Figure 4A:
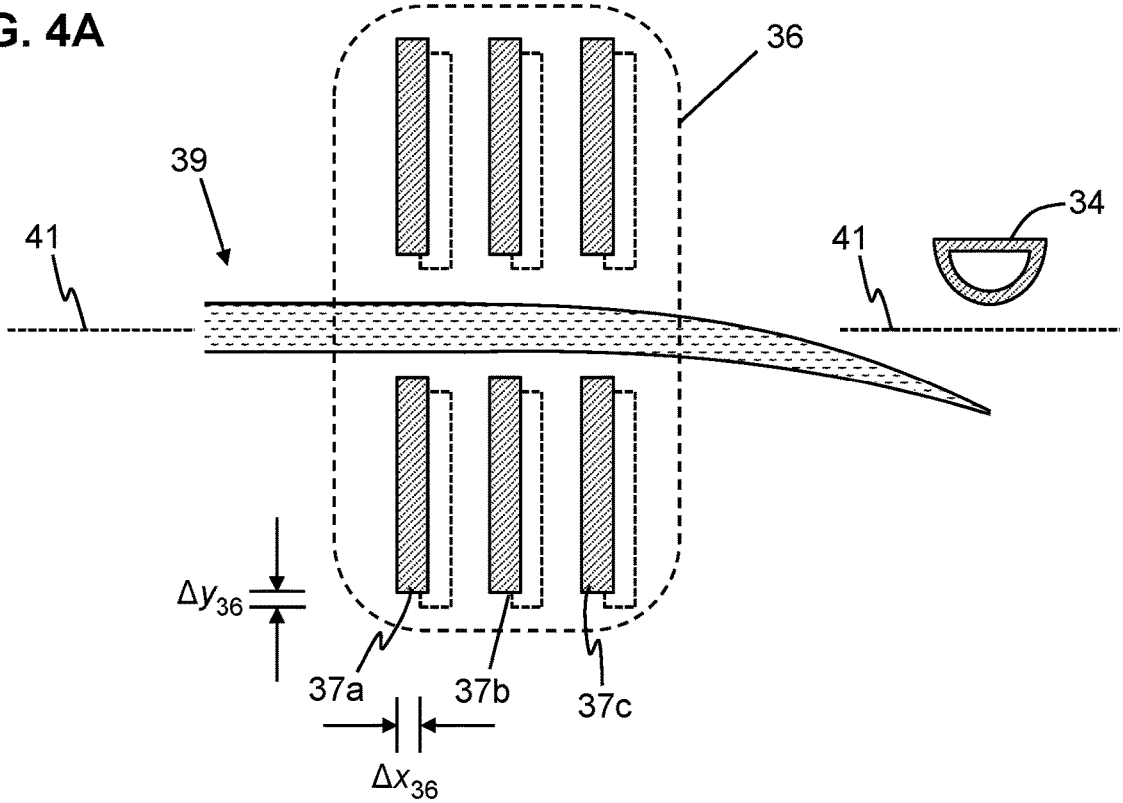
FIG. 4A is a schematic depiction of methods of offsetting the position of an ion focusing lens so as to cause either a shift or a spatial spreading of the focal position of ions passing through the focusing lens.

The above discussion relates to increasing the spatial spread of ion packets entering an electrostatic trap mass analyzer by introducing a perturbation into an ion transfer lens that guides the ion packets from an ion storage apparatus into the mass analyzer. Similar effects may be achieved by introducing perturbations into a focusing upstream from an ion injection aperture of the mass analyzer. Accordingly, FIG. 4A is a schematic depiction of methods, in accordance with the present teachings, of offsetting the position of an ion focusing lens 36 so as to cause either a shift or a spatial spreading of the focal position of ions passing through the focusing lens. In FIG. 4A, an x-axis is defined parallel to the central axis 41 of the nominally constructed lens 36 and ay-axis is defined perpendicular to the x-axis.

In accordance with some methods of the present teachings, the entire lens 36, comprising apertured plate electrodes 37*a*, 37*b* and 37*c*, may be translated, as a unit, relative to its nominal position. The shaded electrodes in FIG. 4A indicate the electrode positions subsequent to translations; the nominal electrode positions are indicated in phantom. The lens may be translated either parallel to the x-axis by a distance $\Delta x_{36}$ or parallel to the y-axis by a distance $\Delta y_{36}$. Alternatively, the translation of the lens may be described as a vector summation of x-axis and y-axis translations.

Simple translations of the ion focusing lens 36 parallel to only the x-axis cause the focus of the lens to shift parallel to the same axis either upstream or downstream from the ion inlet aperture 5 relative to the nominal focal point within the ion inlet aperture. In each instance, the focal point moves the same distance, $\Delta x_{36}$, as the lens is moved. Movement of the lens focal point upstream from the ion inlet aperture (such as to the vicinity of point f32 in FIG. 3A) enlarges the spatial spread of ion packets as they enter the electrostatic trap mass analyzer, thereby reducing mass spectral peak coalescence as noted above.

Simple translations of the ion focusing lens 36 parallel to only the y-axis cause a shift of the lens central axis 41 so that it no longer coincides with the center of the pathway 39 of incoming ions (the pathway assumed here to be fixed by the ion transfer lens 33). In this case, ions that traverse the pathway 39 experience unbalanced repulsive forces from the electric field produced by the energized central plate electrode 37*b*. Such a shift can thus perturb the lens focusing properties of the lens 36 in a fashion similar to that previously described in reference to perturbation of the ion transfer lens 33. Specifically, the lens focal point will move upstream from its nominal position, thereby enlarging the spatial spread of ion packets as they enter the electrostatic trap mass analyzer.

According to an alternative mode of operation of the ion focusing lens 36, the lens assembly remains in a fixed position and, instead of moving the lens, the focal length of the lens is perturbed by means of adjustment of the voltage that is applied to the center plate electrode 37*b* of the lens. Increasing this voltage relative to its nominal value decreases the focal length, thereby causing the ion pathway 39 to come to a focus upstream from the ion injection aperture 5 of the electrostatic trap apparatus 4. Subsequently, the voltage applied to the center plate electrode may be reduced so as to cause the focus to move in the opposite direction back towards, and perhaps beyond the ion injection aperture. As noted above, the adjustment of the focal position can increase the spatial spread of ion packets entering the electrostatic trap, relative to nominal operating conditions and this increased spatial spread can reduce mass spectral peak coalescence.

Figure 4B:
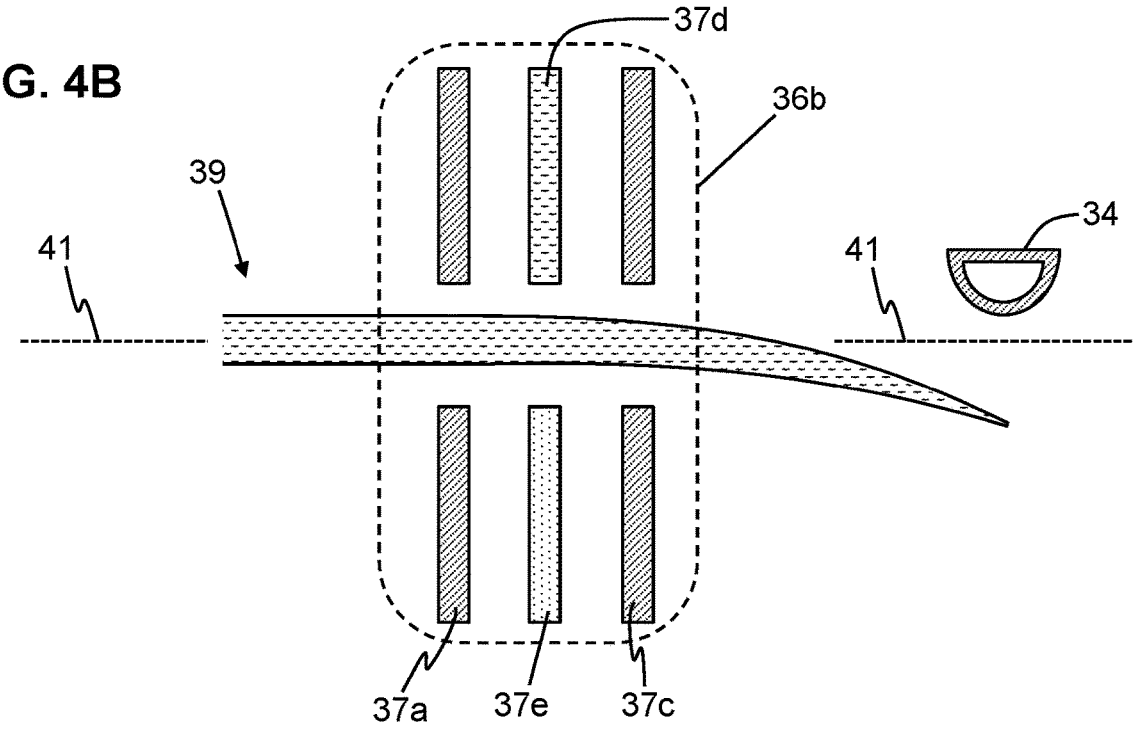
FIG. 4B is a schematic depiction of an ion focusing lens apparatus and method of operating the apparatus to cause either a shift or a spatial spreading of the focal position of ions passing through the focusing lens.

FIG. 4B is a schematic depiction of a modified ion focusing lens apparatus 36*b* as well as a corresponding method, in accordance with the present teachings, for perturbing the operation of an ion focusing lens so as to cause either a shift or a spatial spreading of the focal position of ions. The method depicted in FIG. 4B does not require any physical translation of the focusing lens relative to its nominal position. Instead, the method makes use of the ability to vary electric field strength across a central electrode aperture that is defined between a pair of central electrode plates 37*d*, 37*e*. Specifically, the single center electrode plate 37*b* of the ion transfer lens apparatus 36 (FIG. 1C, FIG. 4A) is replaced, in the lens apparatus 36*b* (FIG. 4B), by the two electrode plates, 37*d* and 37*e*, that are oppositely disposed, relative to one another, across the central axis 41 of the modified ion transfer lens 36*b*. Electrical connections to the electrode plates 37*d* and 37*e* are configured such that an electrical potential difference may be applied between these two electrode plates. The resulting imbalanced electrical field across the width of the ion pathway 39 can cause lens aberrations that lead to an unsharp and spatially spread focal region as the ions enter an ion inlet aperture of an electrostatic trap mass analyzer.

Figure 5A:
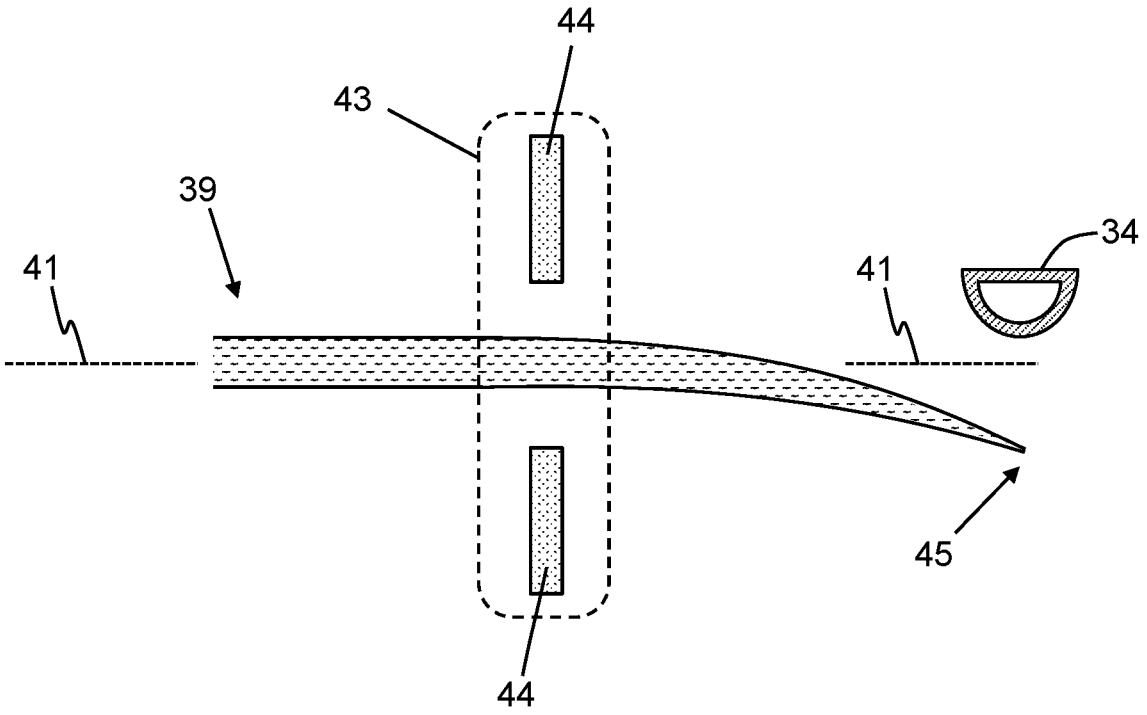
FIG. 5A is a schematic diagram of a quadrupole lens for directing ions into an ion injection slot of an electrostatic trap mass analyzer in accordance with the present teachings.

FIG. 5A is a schematic diagram of a quadrupole lens 43 which may be employed as an alternative to the Einzel focusing lens 36 (e.g., FIG. 1C). As depicted, the lens 43 is a so-called "DC quadrupole" apparatus comprising four quadrupole electrodes 44, two of which are shown in FIG. 5A. As shown in greater detail in FIG. 5B, the quadrupole electrodes are configured as a pair of "x-electrodes" 44*x* and a pair of y-electrodes 44*y*. The electrodes of each pair are oppositely disposed about an axis 41 of a pathway 31 of ions. For descriptive purposes, the axis 41 is herein defined as a z-axis of an x-y-z Cartesian coordinate system. A line (not shown) that connects the centers of the x-electrodes defines an x-axis and a second line (not shown) that connects the centers of the y-electrodes defines ay-axis that is substantially orthogonal to the x-axis. The four electrodes are preferably disposed equidistantly about the axis 41. Although the quadrupole electrodes are depicted as plates having circular cross sections in FIG. 5B, they are not restricted to this shape.

Figure 5B:
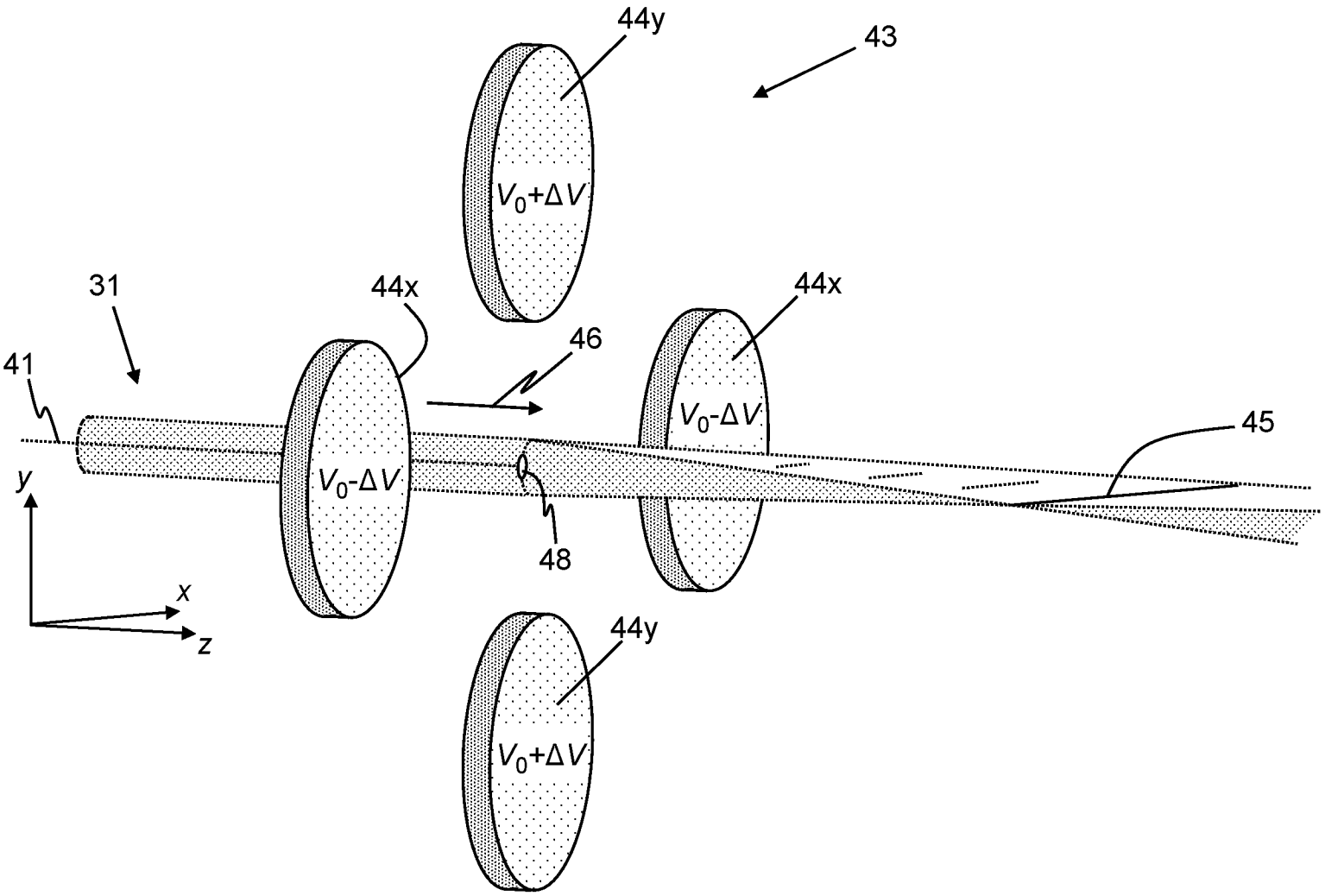
FIG. 5B is a schematic diagram of the focusing properties of the quadrupole lens of FIG. 5A.

Arrow 46 in FIG. 5B represents the propagation direction of ions, parallel to the z-axis (axis 41), along the ion transfer pathway 31 from an ion storage apparatus 2 into an electrostatic trap mass analyzer 4. Let $V_0$ represent the electrical potential at a point 48 that is midway between the x-electrodes and midway between the y-electrodes. According to a first mode of operation of the quadrupole lens apparatus 43, a DC voltage $V_0+\Delta V$ is applied to the y-electrodes 44*y* that causes the trajectories of ions passing through the lens 43 (i.e., in the space between all four electrodes) to be deflected generally towards the x-z plane. At the same time, a DC voltage $V_0-\Delta V$ is applied to the x-electrodes 44*x* that causes the trajectories of the ions to diverge generally away from the y-axis. Depending upon the magnitude and sign (positive versus negative) of $\Delta V$, the voltage applied to the x-electrodes may have the same polarity as the voltage applied to the y-electrodes or an opposite polarity to the voltage applied to the y-electrodes. This first mode of operation may be employed in situations in which the suppression of peak coalescence, through the reduction in charge density or the total number of ions within an electrostatic trap, is deemed to be more important or more advantageous than the optimization of certain other mass spectral characteristics, such as isotope ratio fidelity. For example, if a large population of ions is being introduced into an electrostatic trap mass analyzer, then it may be advantageous to operate the lens 43 so as to generate a focal line 45 or an otherwise diffuse focus region so as to reduce charge density within the trap and thereby reduce peak coalescence.

The application of the first and second voltages to the lens 43, as described above in accordance with the first mode of operation, causes the ion trajectories to converge to a focal line 45 instead of converging to a point-like focus f31, f32, as would otherwise occur using the Einzel focusing lens 36 (FIGS. 3A, 3B). For example, if the ions are positively charged, then employment of an appropriately chosen positive-valued $\Delta V$ can produce the line focus as shown in FIG. 5B. It should be noted that, for purposes of clarity of the illustration of FIG. 5B, the effects of the deflector electrode 34 on the ion trajectories are not depicted in FIG. 5B. Thus, from the effects of the deflector electrode 34, the trajectories of the ions are, in fact, caused to curve away from the z-axis extended and towards the ion inlet aperture 5 after the ions pass through the lens 43. The length of the focal line 45 and the position of this focal line 45 relative to the ion inlet aperture 5 may be controlled by choosing the magnitude of $\Delta V$. Upon passing the ion inlet aperture 5, the ions are captured by the electric fields within the electrostatic trap and their subsequent trajectories within the trap are affected not only by these internal fields but also by the initial positions of the ions upon entering the trap. Because the lens 43 causes each introduced packet of ions to be spatially spread along a focal line 45, the ions of the packet remain spatially separated within the trap, thereby reducing the undesired interactions between ion species having different m/z values and thus reducing peak coalescence effects.

According to a second mode of operation of the quadrupole lens 43, which is not specifically illustrated in the drawings, voltages of $V_0+\Delta V$ (where may be either negative or positive) are applied to both of the pairs of electrodes of the lens such that the ion trajectories converge to a point-like focus, similar to the to a point-like foci 131, f32 that are depicted in FIGS. 3A, 3B. For example, if the ions are positively charged, then employment of an appropriately chosen positive-valued $\Delta V$ can generate a point-like focus. This second mode of operation may be employed in situations in which the optimization of certain mass certain mass spectral characteristics, such as isotope ratio fidelity, is more desirable or more advantageous than is the suppression of peak coalescence. For example, if a small population of ions is being introduced into an electrostatic trap mass analyzer, then it may be advantageous to operate the lens 43 so as to generate a tight point-like focus in order to preserve isotope ratio fidelity and overall peak resolving power. The mode of operation of the quadrupole lens 43 may be changed from the first mode to the second mode, and vice versa, depending upon the requirements of either a particular analysis or a particular set of analyses.

Figure 6:
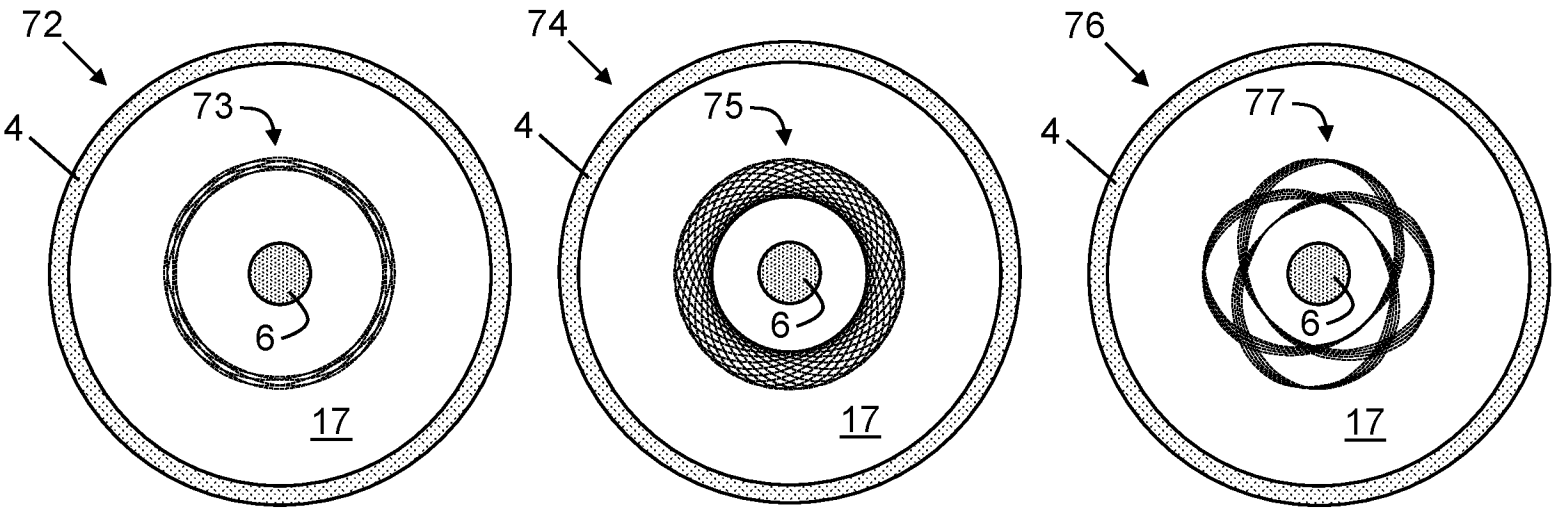
FIG. 6 is a set of schematic depictions of ion orbital trajectories within an electrostatic trap apparatus of the type illustrated in FIGS. 1A and 1B, as projected onto a cross section normal to the longitudinal z-axis, the different cross sections pertaining to different injection voltages applied to the inner spindle electrode during ion injection.

FIG. 6 is a set of simulated initial orbital trajectories within an electrostatic trap of the type shown in FIGS. 1A-1B as calculated at three different injection voltages applied to the central spindle electrode 6. The results depicted in FIG. 6 underpin alternative ion injection methods for controlling peak coalescence or for balancing the loss of spectral resolution resulting from peak coalescence against other mass analyzer performance characteristics. Such alternative ion injection methods to not rely on controlling ion transfer electrodes or entrance lenses but, instead, rely on control of a voltage pulse that may be temporarily applied to the central spindle electrode at the time of ion injection in order to "pull" the ions into the measurement chamber 17. When employed, the injection voltage applied to the central spindle electrode supplements the "push" into the measurement chamber that is provide by the voltage, of opposite polarity, that is applied to the deflector electrode 34.

Diagrams 72, 74 and 76 of FIG. 6 pertain to injection of positively charged ions into an electrostatic trap under increasingly negative injection voltages applied to the central spindle electrode. As this injection voltage pulse becomes increasingly negative, the initial trajectories of the ions are caused to increasingly bend towards the center electrode as they are being "captured" by the pull of the center electrode. Conventionally, as depicted in diagram 72, the injection voltage on the inner spindle electrode is maintained at an optimal value, $V_{injection}^{0}$, such that the extent of this pull of the ions towards the central electrode is well-matched to the entrance energy of the ions. Under such conventional ion injection conditions, the initial orbits of ions about the central electrode follow paths 73 in which the ions maintain orbits that are essentially circular in cross sectional projection. However, the basic form of the orbits changes if the actual applied injection voltage, $V_{injection}$, is not equal to $V_{injection}^{0}$. For example, when the magnitude of the injection voltage is increased, the ion trajectories ions bend more strongly towards the central electrode and the paths 75, 77 of subsequent orbits are increasingly elliptical, as depicted in diagrams 74 and 76. Ions in elliptical orbits eventually hit the inner electrode and are neutralized. In similar fashion, if the magnitude of $V_{injection}$ is less than the magnitude of $V_{injection}^{0}$, ions will follow orbital trajectories that bring them closer to the outer electrodes 4 than shown in diagram 72.

Increasing ellipticity of orbits about the central electrode can lead, in many measurement situations, to one or more of the disadvantageous effects of: diminished overall resolving power, lower signal-to-noise ratio, reduced dynamic range and reduced isotope ratio fidelity. (Note that the term "isotope ratio fidelity" refers to the degree to which an experimentally observed isotope abundance ratio matches an expected isotope abundance ratio.) Nonetheless, the same phenomenon may provide beneficial effects in some other measurement situations. In particular, increasing orbital ellipticity causes each introduced packet of ions to occupy a larger proportion of the measurement chamber 17 of an electrostatic trap, as shown in FIG. 6. As a result, the average distance between ions increases and the average space charge density within the measurement chamber decreases. The reduced space charge density can, in some instances, lead to advantageous reduction in peak coalescence as a result of reduced interactions between different ion species of similar m/z.

Figure 7:
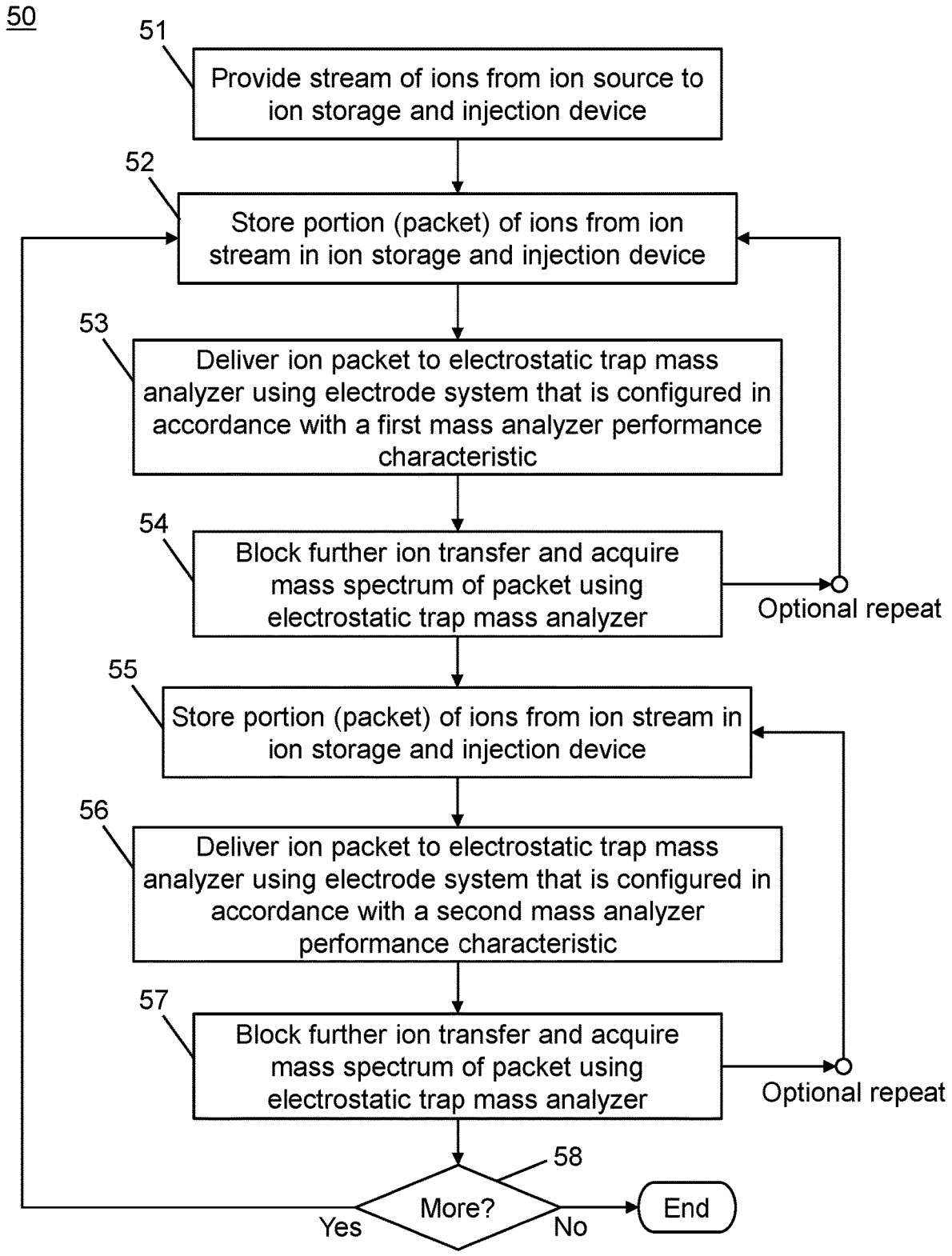
FIG. 7 is a flow diagram of a method, in accordance with the present teachings, for operating a mass spectrometer system comprising an electrostatic trap mass analyzer.

From the above considerations, the inventors have realized that it is advantageous for operators of electrostatic trap mass analyzers to be able to control ion injection conditions into the electrostatic trap so as to balance tradeoffs between frequently beneficial metrics like signal-to-noise ratio and isotopic ratio fidelity, and, at other times, beneficial increased ion-ion separation. In some instances, the changing of ion injection conditions may occur between analyses of different samples in response to different analytical needs between samples. In other instances, the changing of ion injection conditions may occur during repeated analyses of a single sample or even of a single analyte in order to maximize the types and/or quality of information obtained about the analyte. Accordingly, FIG. 7 is a flow diagram of a method 50, in accordance with the present teachings, for controllably varying ion injection conditions during introduction of ions into an electrostatic trap mass analyzer of a mass spectrometer system. In addition to the electrostatic trap mass analyzer, the mass spectrometer system also comprises, inter alia, an ion storage apparatus and an ion transfer and focusing lens system that is disposed between an ion outlet of the ion storage apparatus and an ion inlet aperture of the electrostatic trap mass analyzer.

In step 51 of the method 50 (FIG. 7), a stream of ions is provided from an ion source to the ion storage apparatus. In step 52, a portion of the ions from the incoming stream of ions is accumulated and stored in the ion storage apparatus, this stored portion being herein referred to as a packet of ions. During the time that ions are being accumulated within the ion storage apparatus, the ion transfer and focusing lens system is electrically configured so that ions are not released from the ion storage apparatus to the mass analyzer.

After a certain pre-determined quantity of ions have been stored in the ion storage apparatus or, equivalently, after having accumulated ions for a certain pre-determined duration of time, the next step 53 is executed. In this step, the ion transfer and focusing lens system is configured so as to cause the accumulated packet of ions to exit the ion storage apparatus towards the mass analyzer. The release of the ion packet from the ion storage apparatus occurs under the impetus of an electrical potential difference applied between the lens system and the ion storage apparatus.

During the transfer of the ion packet in step 53, the ion transfer and focusing lens system may, in some instances, be configured in a first configuration so as to cause the packet of ions to enter an ion inlet aperture of the mass analyzer in a spatial configuration that causes the mass analyzer to yield mass spectra in accordance with a first desired performance characteristic or desired set of performance characteristics. In other instances of execution of step 53, a voltage of a first pre-determined magnitude may be applied to an electrode of the mass analyzer so as to yield mass spectra in accordance with the first desired performance characteristic or characteristics. In yet other instances of execution of step 53 both the ion transfer and lens system and the mass analyzer injection voltage may be configured in accordance with the desired performance characteristic(s). As but one example, a first desired performance characteristic may relate to reduction of coalescence of mass spectral peaks that correspond to separate ion species, such as isotopic variants of a single species of molecular ion, that have closely similar m/z values.

If, prior to the execution of step 53, the ion transfer and focusing lens system is not already in an appropriate operating configuration for producing mass spectra having the desired performance characteristic or characteristics, then the execution of step 53 includes reconfiguring the ion transfer and focusing lens system into the proper operating configuration. The reconfiguring may include mechanical displacement of one or more electrodes of the lens system, as indicated by the displacement, $\Delta y_{33}$, as indicated in FIG. 2B or by one or both of the displacements, $\Delta y_{36}$ and $\Delta x_{36}$, as indicated in FIG. 4A. Although the mechanical displacements may be effected by any suitable mechanical translation apparatus, it is preferable to employ one or more piezoelectric transducers for this purpose. In practice, either the electrodes or a lens support structure may be mounted on or adjacent to such transducers. Alternatively, the reconfiguring of the operation of the ion transfer and focusing lens system may be performed by controlling voltages that are applied to lens electrodes, as is indicated in FIG. 2A and FIG. 4B.

Step 54 is executed once the packet of ions has been transferred from the ion storage apparatus to the electrostatic trap mass analyzer. In this step, the ion transfer and focusing lens system is reconfigured such that no additional ions are transferred out of the ion storage apparatus and such that the transferred packet of ions is trapped within the mass analyzer. During this step, mass analysis of the packet of ions is performed by the mass analyzer and mass spectral data is generated. Execution of the method 50 then returns to step 52 in which a new packet of ions is accumulated within the ion storage apparatus. All or a portion of the accumulation of the new packet of ions (step 52) in the ion storage apparatus may occur simultaneously with the mass analysis of the prior packet of ions (step 54) in the electrostatic trap mass analyzer. After the completion of the mass analysis, any remaining ions from the prior packet of ions are expelled from the mass analyzer and, once the new packet of accumulated ions is ready to be transferred from the ion storage apparatus, execution may optionally return to the step 52. Optionally, execution of the method 50 may repeatedly loop through the steps 52-54 a variable number of times. The exact number, m, of times that the loop is executed (where m≥1) depends on many experimental variables, such as the nature and concentration of compounds in the sample, the type of analysis being performed, etc.

After completion of the m iterations of the execution of steps 52-54, where m≥1, the execution of the method 50 branches to step 55. Steps 55, 56 and 57 are analogous to steps 52, 53 and 54, respectively. Specifically, ion storage step 55 and mass analysis step 57 are identical to steps 52 and 54, respectively. The intervening step 56 is similar to step 53 but differs from step 53 in that, in the step 56, either the ion transfer and focusing lens system or the mass analyzer electrode injection voltage (or both) is/are reconfigured so as to cause the mass analyzer to yield mass spectra in accordance with a second desired performance characteristic or a second desired set of performance characteristics. In some instances, the execution of step 56 may comprise reconfiguring the ion transfer and focusing lens system in a second configuration so as to cause the packet of ions to enter the ion inlet aperture of the mass analyzer in a second spatial configuration that causes the mass analyzer to exhibit the desired performance characteristic or characteristics. In other instances of execution of step 56, a voltage of a second pre-determined magnitude may be applied to an electrode of the mass analyzer so as to yield mass spectra in accordance with the first desired performance characteristic or characteristics. In yet other instances of execution of step 56 both the ion transfer and lens system and the mass analyzer injection voltage may be configured in accordance with the desired performance characteristic(s).

The steps 55-57 comprise a second set of steps that, optionally, may be repeated a variable number of times. In other words, the set of steps 55-57 may be executed at total of n times, where n≥1. Whereas the first set of possibly-iterated steps (steps 52-54) comprise a set of mass analyses during which the first desired mass spectral characteristic or first desired set of mass spectral characteristics is optimized, the second iterated set of steps (steps 55-57) comprise another set of mass analyses during which the second desired mass spectral characteristic(s) is/are optimized. For instance, a second desired performance characteristic may relate to improvement of mass spectral signal-to-noise ratio by permitting some level of coalescence of isotopic variant peaks.

Generally, the first and second mass spectral characteristics or sets of characteristics described above correspond to different types of mass spectral information, the simultaneous optimization of which is difficult to achieve. For example, if the mass spectral resolution of closely-spaced isotopes of a given compound is an analytical goal, then it may be desirable to operate a mass spectrometer system having an electrostatic trap mass analyzer in a fashion so as so minimize peak coalescence as described above. Conversely, if it desired to use mass analysis to accurately quantify a low concentration of a known compound in a sample, then the lower limit of quantitation may be improved by taking advantage of signal-to-noise improvements that occur when isotopic variant peaks are allowed to coalesce. In the first example, ion transfer and focusing optics may be configured and/or operated such that the pathways of ion packets are de-focused or otherwise spatially spread as they enter the electrostatic trap mass analyzer at its ion inlet aperture. In the second example, the ion transfer and focusing optics may be configured and/or operated according to nominal operation, in which the ion pathways are tightly focused at the position of the ion inlet aperture.

The execution of steps 52-54 and the execution of the steps 55-57 of the method 50 may both pertain to a same sample composition, possibly as part of a single analysis. Such situations may apply when it is desired to obtain optimal measurements of both the first and second mass spectral characteristics pertaining to the single sample. Alternatively, the execution of steps 52-54 and the execution of the steps 55-57 may pertain to different sample compositions, derived from either different samples or from a single sample. In the latter case, the different sample compositions may be introduced in succession into the mass spectrometer as a result of separation of sample constituents by a separation or fractionation apparatus, such as a chromatograph, that provides sample material to the mass spectrometer system. In such instances, the change from execution of steps 52-54 (if repetitively executed) to execution of steps 55-57 may be made automatically in response to analysis of mass spectral data generated by the mass spectrometer. After completion of the possibly repeated execution of steps 55-57, execution of the method 50 may return, as a result of a decision made in decision step 58, to step 52, after which the set of steps 52-54 may again be executed, perhaps multiple times.

The discussion included in this application is intended to serve as a basic description. Although the invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the scope and essence of the invention. Neither the description nor the terminology is intended to limit the scope of the invention. Any patents, patent applications, patent application publications or other literature mentioned herein are hereby incorporated by reference herein in their respective entirety as if fully set forth herein.

What is claimed is:

1. A method of operating a mass spectrometer system comprising an electrostatic trap mass analyzer, comprising:

storing a portion of a stream of ions generated by an ion source as a first packet of ions within an ion storage apparatus of the mass spectrometer system;

transferring the first stored packet of ions into an electrostatic trap mass analyzer through a set of electrostatic lenses, wherein, during the transfer of the first packet of ions into the electrostatic trap mass analyzer, either the electrostatic lenses are operated in a first mode of operation or an injection voltage of a first pre-determined magnitude is applied to an electrode of the mass analyzer;

mass analyzing the first packet of ions using the electrostatic trap mass analyzer;

storing a second portion of the stream of ions as a second packet of ions within the ion storage apparatus;

transferring the second stored packet of ions into the electrostatic trap mass analyzer through the set of electrostatic lenses, wherein, during the transfer of the second packet of ions into the electrostatic trap mass analyzer, either the electrostatic lenses are operated in a second mode of operation or an injection voltage of a second pre-determined magnitude is applied to the electrode of the mass analyzer; and mass analyzing the second packet of ions using the electrostatic trap mass analyzer.

2. A method of operating a mass spectrometer system comprising an electrostatic trap mass analyzer as recited in claim 1, wherein a change of the mode of operation of the electrostatic lenses from the first to the second mode of operation or a change of the injection voltage from the first to the second pre-determined magnitude reduces coalescence of mass spectral peaks in a second mass spectrum generated by the mass analyzing of the second packet of ions relative to a first mass spectrum generated by the mass analyzing of the first packet of ions.

3. A method of operating a mass spectrometer system comprising an electrostatic trap mass analyzer as recited in claim 1, wherein a change of the mode of operation of the electrostatic lenses from the first to the second mode of operation or a change of the injection voltage from the first to the second pre-determined magnitude causes increased resolution of mass spectral peaks or improved signal-to-noise in a second mass spectrum generated by the mass analyzing of the second packet of ions relative to a first mass spectrum generated by the mass analyzing of the first packet of ions.

4. A method of operating a mass spectrometer system comprising an electrostatic trap mass analyzer as recited in claim 1, wherein a change of the mode of operation of the electrostatic lenses from the first to the second mode of operation or a change of the injection voltage from the first to the second pre-determined magnitude is made in response to a difference between the ion population sizes of the first and second packets of ions.

5. A method of operating a mass spectrometer system comprising an electrostatic trap mass analyzer as recited in claim 1, wherein a change of the mode of operation of the electrostatic lenses from the first to the second mode of operation comprises changing at least one voltage that is applied to a lens electrode.

6. A method of operating a mass spectrometer system comprising an electrostatic trap mass analyzer as recited in claim 5, wherein the changing of the at least one voltage causes a shift, relative to an ion entrance aperture of the electrostatic trap mass analyzer, of an ion focal position.

7. A method of operating a mass spectrometer system comprising an electrostatic trap mass analyzer as recited in claim 5, wherein the changing of the at least one voltage comprises changing at least one voltage applied to a DC quadrupole lens.

8. A method of operating a mass spectrometer system comprising an electrostatic trap mass analyzer as recited in claim 1, wherein a change of the mode of operation of the electrostatic lenses from the first to the second mode of operation comprises changing a position of a lens electrode.

9. A method of operating a mass spectrometer system comprising an electrostatic trap mass analyzer as recited in claim 8, wherein the changing of the lens position causes a shift, relative to an ion entrance aperture of the electrostatic trap mass analyzer, of an ion focal position.

10. A method of operating a mass spectrometer system comprising an electrostatic trap mass analyzer as recited in claim 1, wherein:

the first and second injection voltages are both applied to a central spindle electrode of the electrostatic trap and have a polarity that is attractive to ions of the first and second packets of ions; and a change of the injection voltage from the first to the second pre-determined magnitude comprises increasing a magnitude of the second injection voltage relative to a magnitude of the first injection voltage in order to reduce coalescence of mass spectral peaks in a second mass spectrum generated by the mass analyzing of the second packet of ions relative to a first mass spectrum generated by the mass analyzing of the first packet of ions.

11. A method of operating a mass spectrometer system comprising an electrostatic trap mass analyzer as recited in claim 1, wherein:

the first and second injection voltages are both applied to a central spindle electrode of the electrostatic trap and have a polarity that is attractive to ions of the first and second packets of ions; and a change of the injection voltage from the first to the second pre-determined magnitude comprises decreasing a magnitude of the second injection voltage relative to a magnitude of the first injection voltage in order to increase a lifetime of the second packet of ions within an analysis chamber of the electrostatic trap mass analyzer relative to a lifetime of the first packet of ions within the analysis chamber.

12. A method of operating a mass spectrometer system comprising an electrostatic trap mass analyzer as recited in claim 1, wherein a change of the mode of operation of the electrostatic lenses from the first to the second mode of operation or a change of the injection voltage from the first to the second pre-determined magnitude is performed between successive mass spectral analyses of a single sample or between successive mass spectral analyses of a single analyte.

13. A method of operating a mass spectrometer system comprising an electrostatic trap mass analyzer as recited in claim 1, wherein a change of the mode of operation of the electrostatic lenses from the first to the second mode of operation or a change of the injection voltage from the first to the second pre-determined magnitude is performed between a mass analysis of a first sample and a mass analysis of a second sample or between a mass analysis of a first analyte and a mass analysis of a second analyte.

14. A mass spectrometer system, comprising:

an ion source;

an ion storage apparatus configured to receive ions from the ion source;

an electrostatic trap mass analyzer configured to receive packets of ions from the ion storage apparatus, the electrostatic trap mass analyzer comprising:

an inner spindle electrode; and one or more outer electrodes;

a space between inner spindle electrode and the one or more outer electrodes; and an ion inlet aperture of the one or more outer electrodes;

a set of ion lenses disposed between the ion storage apparatus and the electrostatic trap mass analyzer;

a power supply electrically coupled to the ion storage apparatus, the electrostatic trap mass analyzer and the set of ion lenses; and an information processor electrically coupled to one or more of the power supply, the ion storage apparatus, the electrostatic trap mass analyzer and the set of ion lenses and comprising computer readable instructions operable to:

cause storage of a portion of a stream of ions generated by the ion source as a first packet of ions within the ion storage apparatus;

cause transfer of the first stored packet of ions into the space of the electrostatic trap mass analyzer through the set of electrostatic lenses, wherein, during the transfer of the first packet of ions into the space, either the electrostatic lenses are operated in a first mode of operation or an injection voltage of a first pre-determined magnitude is applied to the spindle electrode;

cause the electrostatic trap mass analyzer to mass analyze the first packet of ions;

cause storage of a second portion of the stream of ions as a second packet of ions within the ion storage apparatus;

cause transfer of the second stored packet of ions into the electrostatic trap mass analyzer through the set of electrostatic lenses, wherein, during the transfer of the second packet of ions into the electrostatic trap mass analyzer, either the electrostatic lenses are operated in a second mode of operation or an injection voltage of a second pre-determined magnitude is applied to the electrode of the mass analyzer; and cause the electrostatic trap mass analyzer to mass analyze the second packet of ions.

15. A mass spectrometer system as recited in claim 14, wherein the information processor comprises computer readable instructions that are further operable to cause a change of the mode of operation of the electrostatic lenses from the first to the second mode of operation or a change of the injection voltage from the first to the second pre-determined magnitude so as to reduce coalescence of mass spectral peaks in a second mass spectrum generated by the mass analyzing of the second packet of ions relative to a first mass spectrum generated by the mass analyzing of the first packet of ions.

16. A mass spectrometer system as recited in claim 14, wherein the information processor comprises computer readable instructions that are further operable to cause a change of the mode of operation of the electrostatic lenses from the first to the second mode of operation or a change of the injection voltage from the first to the second pre-determined magnitude so as to cause increased resolution of mass spectral peaks or improved signal-to-noise in a second mass spectrum generated by the mass analyzing of the second packet of ions relative to a first mass spectrum generated by the mass analyzing of the first packet of ions.

17. A mass spectrometer system as recited in claim 14, wherein the information processor comprises computer readable instructions that are further operable to cause a change of the mode of operation of the electrostatic lenses from the first to the second mode of operation or a change of the injection voltage from the first to the second pre-determined magnitude in response to a difference between the ion population sizes of the first and second packets of ions.

18. A method of operating a mass spectrometer system comprising an electrostatic trap mass analyzer as recited in claim 14, wherein the computer readable instructions are operable to cause a shift, relative to an ion entrance aperture of the electrostatic trap mass analyzer, of an ion focal position.

19. A method of operating a mass spectrometer system comprising an electrostatic trap mass analyzer as recited in claim 14, wherein the computer readable instructions are operable to cause a change in a position of a lens electrode.

* * * * *